US010228662B2

(12) United States Patent
Morohoshi et al.

(10) Patent No.: US 10,228,662 B2
(45) Date of Patent: Mar. 12, 2019

(54) ELECTRONIC TIMEPIECE

(71) Applicant: CASIO COMPUTER CO., LTD., Shibuya-ku, Tokyo (JP)

(72) Inventors: Hiroshi Morohoshi, Tokorozawa (JP); Takeshi Miyake, Tokyo (JP); Tatsuyoshi Omura, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 63 days.

(21) Appl. No.: 15/204,670

(22) Filed: Jul. 7, 2016

(65) Prior Publication Data

US 2017/0082980 A1 Mar. 23, 2017

(30) Foreign Application Priority Data

Sep. 18, 2015 (JP) ..... 2015-184579
Mar. 16, 2016 (JP) ..... 2016-051917

(51) Int. Cl.

| | |
|---|---|
| ***G04G 9/00*** | (2006.01) |
| ***G04B 47/06*** | (2006.01) |
| ***G04C 3/14*** | (2006.01) |
| ***G04G 5/04*** | (2006.01) |

(52) U.S. Cl.

CPC ..... *G04G 9/0005* (2013.01); *G04B 47/06* (2013.01); *G04C 3/14* (2013.01); *G04G 5/04* (2013.01)

(58) Field of Classification Search

CPC ..... G04B 19/04; G04B 19/082; G04B 47/06; G04C 3/14; G04C 3/146; G04G 9/0005

See application file for complete search history.

(56) References Cited

U.S. PATENT DOCUMENTS

| | | | | |
|---|---|---|---|---|
| 4,683,408 | A * | 7/1987 | Inoue | H02P 8/12 318/685 |
| 4,862,051 | A * | 8/1989 | Moteki | G11B 21/085 318/685 |
| 5,119,349 | A * | 6/1992 | Muto | G04C 3/14 368/107 |
| 6,542,439 | B1 * | 4/2003 | Satodate | G04B 19/048 368/223 |
| 2006/0255761 | A1 * | 11/2006 | Fekete | H02P 8/02 318/696 |
| 2008/0151700 | A1 * | 6/2008 | Inoue | G04G 9/0082 368/80 |
| 2008/0253235 | A1 * | 10/2008 | Hiraga | G04B 19/082 368/172 |
| 2014/0064040 | A1 * | 3/2014 | Hirokawa | G04B 19/02 368/80 |

(Continued)

FOREIGN PATENT DOCUMENTS

| | | | |
|---|---|---|---|
| JP | 60162980 | A | 8/1985 |
| JP | 2011069621 | A | 4/2011 |
| JP | 2012110490 | A | 6/2012 |

*Primary Examiner* — Daniel Wicklund
(74) *Attorney, Agent, or Firm* — Holtz, Holtz & Volek PC

(57) ABSTRACT

An electronic timepiece includes a turnable hand and a processor that controls a turn of the hand. When the processor performs a rapid shift of the hand to a set target position, the processor performs a control of a damping of reciprocation of the hand in which the hand performs a predetermined reciprocation about the target position as a reference position and gradually decreases an amplitude of the reciprocation thereof during the rapid shift.

17 Claims, 29 Drawing Sheets

(56) References Cited

U.S. PATENT DOCUMENTS

| | | | | |
|---|---|---|---|---|
| 2014/0219068 | A1* | 8/2014 | Kyou | G04C 3/143<br>368/186 |
| 2014/0286138 | A1* | 9/2014 | Hasegawa | G04C 3/14<br>368/80 |

* cited by examiner

| | | |
|---|---|---|
| UPDATING INTERVAL dt | 1/6 (sec) | 472 |
| ACCELERATION a0 | 144 (pps/sec) | |
| COEFFICIENT OF RESTITUTION r | 0.65 | |
| NUMBER OF BACKLASH STEPS Bm OF MINUTE HAND | 2 | 471 |
| NUMBER OF BACKLASH STEPS Bh OF HOUR AND MINUTE HAND | 6 | |

FIG.23

473

| k | $P_r(t_k)$ |
|---|---|
| 0 | 1.00 |
| 1 | 0.81 |
| 2 | 0.51 |
| 3 | 0.16 |
| 4 | −0.14 |
| 6 | −0.49 |
| 7 | −0.50 |
| 8 | −0.40 |
| 16 | 0.12 |
| 17 | 0.04 |
| 18 | 0.00 |

FIG.25A
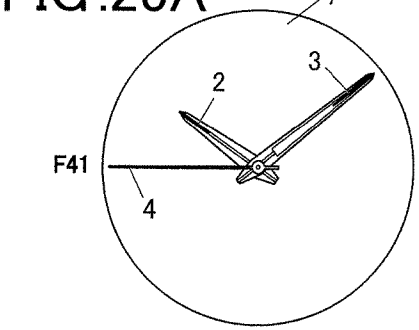
FIG.25B
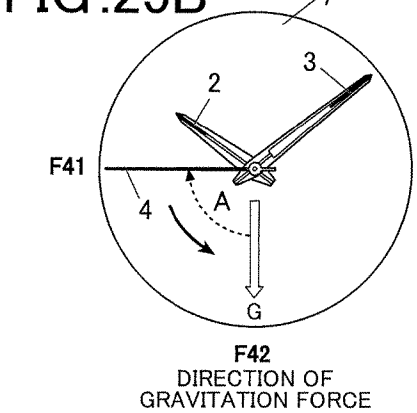
FIG.25C
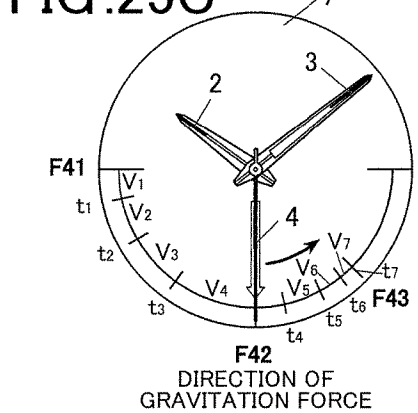
FIG.25D
FIG.25E
FIG.25F

ELECTRONIC TIMEPIECE

CROSS-REFERENCE TO RELATED APPLICATIONS

This application is based upon and claims the benefit of priority under 35 USC 119 of Japanese Patent Application No. 2015-184579 filed on Sep. 18, 2015 and Japanese Patent Application No. 2016-051917 filed on Mar. 16, 2016 the entire disclosure of which, including the descriptions, claims, drawings, and abstracts, is incorporated herein by reference in its entirety.

BACKGROUND OF THE INVENTION

1. Field of the Invention

The present invention relates to an electronic timepiece that displays information with hands.

2. Description of Related Art

Analog electronic timepieces have been known that display the time and date by electrically operating stepping motors to rotate gears and hands in cooperation with the gears. Some analog electronic timepieces can switch the displayed local time among different time zones, display an alarm time, and provide stopwatch and timer functions. Multi-function electronic timepieces measure various physical quantities, such as atmospheric pressure, temperature, azimuth, and the direction of gravitational force, and display information on such physical quantities with the hands.

The hands of such an analog electronic timepiece are often shifted between different indication positions to switch the display of local time, measured values, and functions. The rapid shift of hands can be carried out only at a limited rate. Thus, the switching of the display usually requires a certain time corresponding to the distance of the shifting of hands. A technique is known for reducing the time required for rapid shift of the hands without excess consumption of electric power (for example, refer to Japanese Patent Application Laid-Open Nos. 60-162980 and 2011-069621).

Unfortunately, the rate of simple rapid shift of the hands of such an electronic timepiece is limited to a certain level. Thus, the user still has to wait until the updated value is displayed after the rapid shift.

SUMMARY OF THE INVENTION

The present invention relates to an electronic timepiece that can effectively inform a user about the arrival of a hand to a destination of rapid shift.

According to one aspect of the present invention, there is provided an electronic timepiece including: a turnable hand; and a processor that controls a turn of the hand, wherein, when the processor performs a rapid shift of the hand to a set target position, the processor performs a control of a damping of reciprocation of the hand in which the hand performs a predetermined reciprocation about the target position as a reference position and gradually decreases an amplitude of the reciprocation thereof during the rapid shift.

BRIEF DESCRIPTION OF THE DRAWINGS

The present invention is fully understood form the detailed description given hereafter and the accompanying drawings, which are given byway of illustration only and thus are not intended to limit the present invention, wherein:

FIGS. 7A to 70 illustrate specific examples of shifting of the hands of the analog electronic timepiece according to the first embodiment during the rapid shift control;

FIG. 23 illustrates an example of content of an oscillation damping table;

FIGS. 25A to 25F illustrate example displays of a direction of gravitational force in the analog electronic timepiece according to the sixth embodiment;

DESCRIPTION OF THE PREFERRED EMBODIMENT

Embodiments of the present invention will now be described with reference to the accompanying drawings.

First Embodiment

Figure 1:
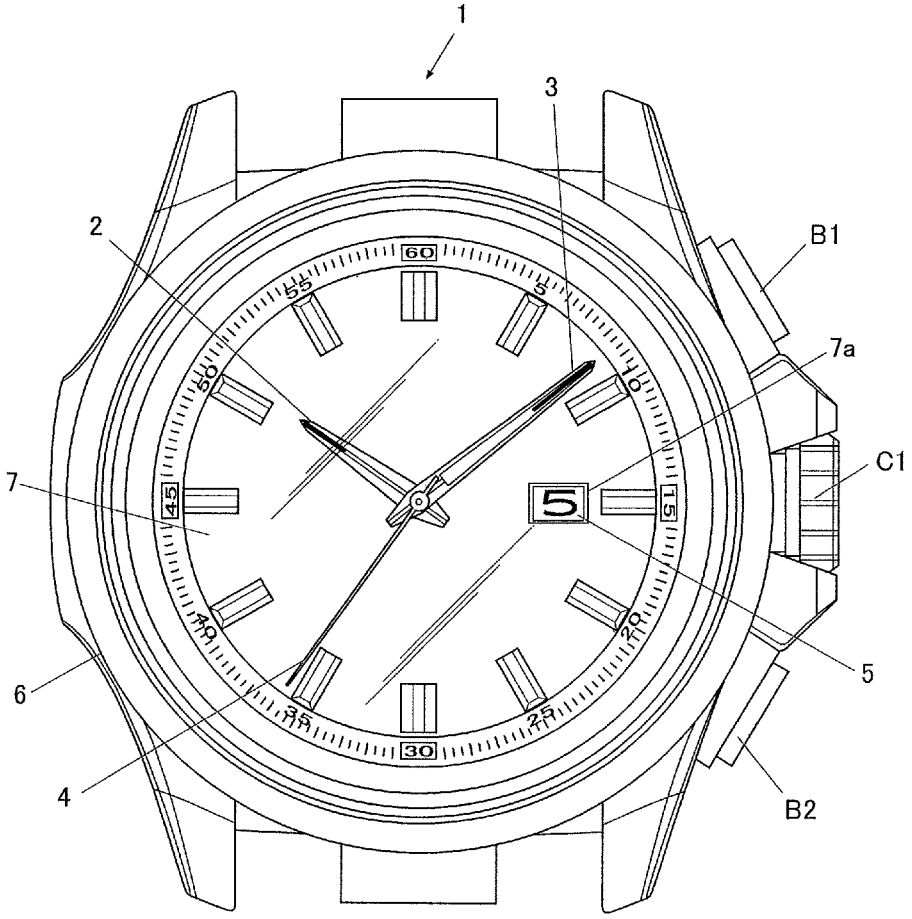
FIG. 1 is a front view illustrating an analog electronic timepiece according to a first embodiment of the present invention.

FIG. 1 is a front view of an analog electronic timepiece 1 according to a first embodiment of the present invention.

The analog electronic timepiece 1 (electronic timepiece) according to this embodiment can display the date and time with four hands including a rotary disk. The analog electronic timepiece 1 includes a casing 6, a timepiece face 7, an hour hand 2 (secondary hand), a minute hand 3 (primary hand), and a second hand 4. The hour hand 2, the minute hand 3, and the second hand 4 are disposed between the timepiece face 7 and a windproof glass (not shown) covering the front face of the timepiece face 7. A discoid date wheel 5 is disposed parallel to the timepiece face 7 on the rear face of the timepiece face 7. Numerals "1" to "31" representing dates are provided at equal intervals (at every 360/31 degrees) in an ascending order on the circumference of the face of the date wheel 5 adjacent to the timepiece face 7. One of the numerals is selectively exposed through an opening 7*a* in the timepiece face 7 to display the date.

The hour hand 2, the minute hand 3, the second hand 4, and the date wheel 5 (which are hereinafter collectively referred to as hands 2 to 5) can rotate 360 degrees around the same axis at the substantial center of the timepiece face 7 in planes parallel to each other.

The side face of the casing 6 is provided with push-button switches B1 and B2 and a crown C1.

Figure 2:
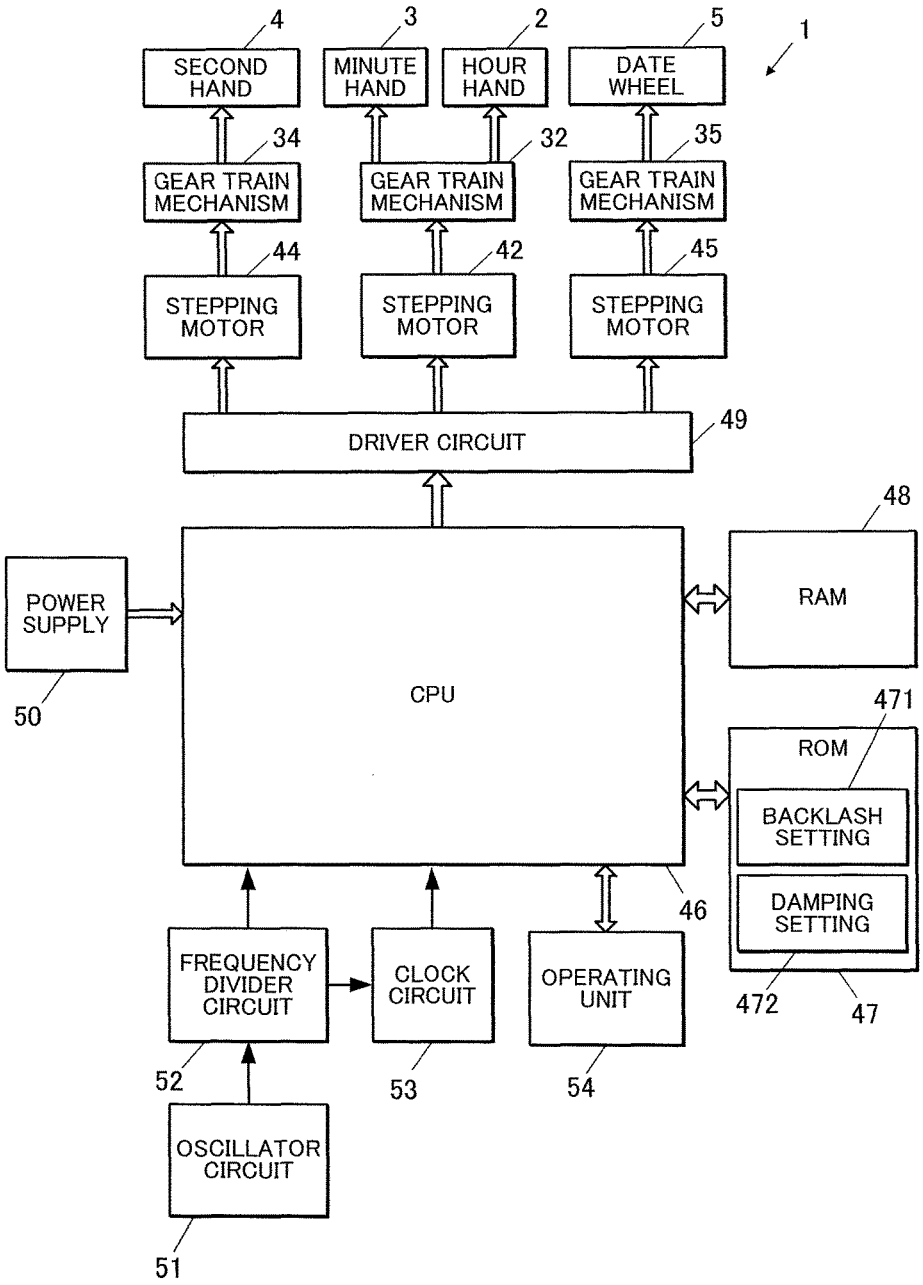
FIG. 2 is a block diagram illustrating the functional configuration of the analog electronic timepiece according to the first embodiment.

FIG. 2 is a block diagram illustrating the functional configuration of the analog electronic timepiece 1 according to the first embodiment.

The analog electronic timepiece 1 includes a hour hand 2, a minute hand 3, a stepping motor 42 that turns the hour hand 2 and the minute hand 3 in cooperation via a gear train mechanism 32, a second hand 4, a stepping motor 44 (hand driver) that turns the second hand 4 via a gear train mechanism 34, a date wheel 5, a stepping motor 45 that turns the date wheel 5 via a gear train mechanism 35, a controller or central processing unit (CPU) 46, a read only memory (ROM) 47, a random access memory (RAM) 48, a driver circuit 49, a power supply 50, an oscillator circuit 51, a frequency divider circuit 52, a clock circuit 53, and an operating unit 54.

The CPU 46 or processor carries out various calculation processes and comprehensively controls the overall operation of the analog electronic timepiece 1. The CPU 46 outputs control signals for operation of the hour hand 2, the minute hand 3, the second hand 4, and the date wheel 5, to the driver circuit 49.

The ROM 47 stores various programs executed by the CPU 46 and default data for these programs. The programs and default data are read and executed by the CPU 46 after start-up of the analog electronic timepiece 1 and when required.

The ROM 47 may be any non-volatile memory, such as a rewritable flash memory or an electrically erasable and programmable read only memory (EEPROM). The data stored in the ROM 47 contains backlash setting 471 for the backlash level of the hands 2 to 5 and damping setting 472 for rapid shift of the hour hand 2 and the minute hand 3, as described below.

The RAM 48 provides a work area for the CPU 46 and temporarily stores data.

The power supply 50 supplies electrical power required for operation to the CPU 46 and individual components of the analog electronic timepiece 1. An example of the power supply 50 is a battery unit that combines a photovoltaic panel and a secondary battery for a long-term, stable power supply.

The oscillator circuit 51 generates predetermined frequency signals and outputs the signals to the frequency divider circuit 52. The frequency divider circuit 52 divides the frequency signals from the oscillator circuit 51, generates signals with frequencies determined by control signals from the CPU 46, and output these signals to the CPU 46. The frequency divider circuit 52 generates predetermined frequency signals (for example, a one-second signal) and outputs the signals to the clock circuit 53.

The clock circuit 53 serves as a counter for counting the input frequency signals thereby counting the date and time. The counter may be a counter circuit in the form of hardware or may be a RAM storing software that counts the date and time in the CPU 46.

The operating unit 54 receives an external instruction by a user, converts the instruction into an electrical signal, and outputs this signal to the CPU 46. The operating unit 54 includes the push-button switches B1 and B2 and the crown C1. The push-button switches B1 and B2 and the crown C1 can be externally operated to instruct the CPU 46 to switch the display and operation by the hands 2 to 4, and select various parameters.

The stepping motors 42, 44, and 45 can drive the hands 2 to 5 on the basis of the waveform of a pulsed driving voltage from the driver circuit 49; for example, the rotors are rotated by 180 degrees relative to the stators to turn the hour hand 2, the minute hand 3, the second hand 4, and the date wheel 5 by predetermined angles in the clockwise or counterclockwise direction. The stepping motors 42, 44, and 45 according to this embodiment can rotate the rotors at variable rates with a maximum rate of 200 pulse per second (pps) in the clockwise or counterclockwise direction.

The gear trains of the gear train mechanisms 32, 34, and 35 transfer the rotational movement of the respective stepping motors 42, 44, and 45 to the hour hand 2, the minute hand 3, the second hand 4, and the date wheel 5 to turn the hands 2 to 5 by predetermined angles.

The gear train mechanisms 32, 34, and 35 of the analog electronic timepiece 1 according to this embodiment turn the minute hand 3 by one degree, the second hand 4 by 6 degrees, and the date wheel 5 by 2/31 degrees for each step of the corresponding stepping motors 42, 44, and 45. The gear train mechanism 32 turns the hour hand 2 by 1/12 degrees as the minute hand 3 turns by one degree. The second hand 4 has positions "0" to "59" along the clockwise direction, where position "0" corresponds to the 0 o'clock position. The minute hand 3 and the hour hand 2 have positions "0" to "4319" (combination of positions) along the clockwise direction, where position "0" corresponds to the 0:00 position. The date wheel 5 has positions "0" to "5579" along the clockwise direction, where position "0" corresponds to the position at which the numeral "1" representing the first day of the month is exposed from the central portion of the opening 7*a*.

The gear train mechanisms 32, 34, and 35 are mounted with a slight allowance or backlash for the transfer of the rotational movement of the stepping motors 42, 44, and 45 to the hands 2 to 5. Thus, when the hands 2 to 5 are to be rotated in the opposite direction, the hands 2 to 5 remain in position before moving in the opposite direction, until the stepping motors 42, 44, and 45 turn by the number of steps corresponding to the allowance. The hands 2 to 5 have different numbers of steps corresponding to the backlash. The hour hand 2 has a backlash corresponding to the allowance characteristic to a gear train in the gear train mechanism 32 branching from another gear train in the gear train mechanism 32 having a backlash for the rotation of the minute hand 3. The positions actually indicated by the hands 2 to 5 on the timepiece face 7 (actual positions) correspond to or coincide with the current positions P of the second hand 4, the hour hand 2, and the minute hand 3 (primary hand), which are positions determined by the number of driving pulses output from the driver circuit 49 without allowance in the gear train mechanisms 32, 34, and 35 during the clockwise rotation of the hands 2 to 5. Thus, during counterclockwise rotation of the hands 2 to 5, the actual positions differ from the current positions P by the number of steps of the backlash (i.e., the current positions P have smaller values than those of the actual positions).

The driver circuit 49 outputs driving pulses to the stepping motors 42, 44, and 45 on the basis of the control signals from the CPU 46. When receiving a control signal for simultaneous operation of more than one of the stepping motors 42, 44, and 45 from the CPU 46, the driver circuit 49 can adjust the operation timing, the peak voltage of the driving pulses, and the pulse width of the output peak voltages.

The rapid shift of the hands of the analog electronic timepiece 1 according to this embodiment will now be described.

In the rapid shift of the hands 2 to 5 of the analog electronic timepiece 1, the target hand is shifted to a target position at a predetermined rapid shift rate (usually the maximum rate 200 pps) and then reciprocates multiple times within a predetermined range across the target or reference position (predetermined reciprocation). The reciprocation of the shifted hand is damped as the magnitude (amplitude) of the reciprocation of the hands is sufficiently decreased, and the rapidly shifted hands finally stop at the target position.

During the rapid shift control of the hands 2 and 3 of the analog electronic timepiece 1 according to this embodiment, the sign of the velocity of the hands 2 and 3 that reach the target position is inverted at the target position to continue the rapid shift of the hands 2 and 3 in the opposite direction at an initial velocity equal to the sign-inverted velocity. The rapid shift in the original direction, i.e., the direction toward the target position has a predetermined acceleration (>0). The hands 2 and 3 decelerate as they shift away from the target position, and accelerate again as they shift toward the target position. That is, the hands 2 and 3 of the analog electronic timepiece 1 imitate the movement of an object bouncing on a floor, which corresponds to the target position, under a gravitational force (bouncing movement). The initial velocity is damped at the beginning of every cycle of the bouncing movement to reduce the amplitude of the bouncing movement such that the minute hand 3 finally stops at the target position.

Figures 3A, 3B:
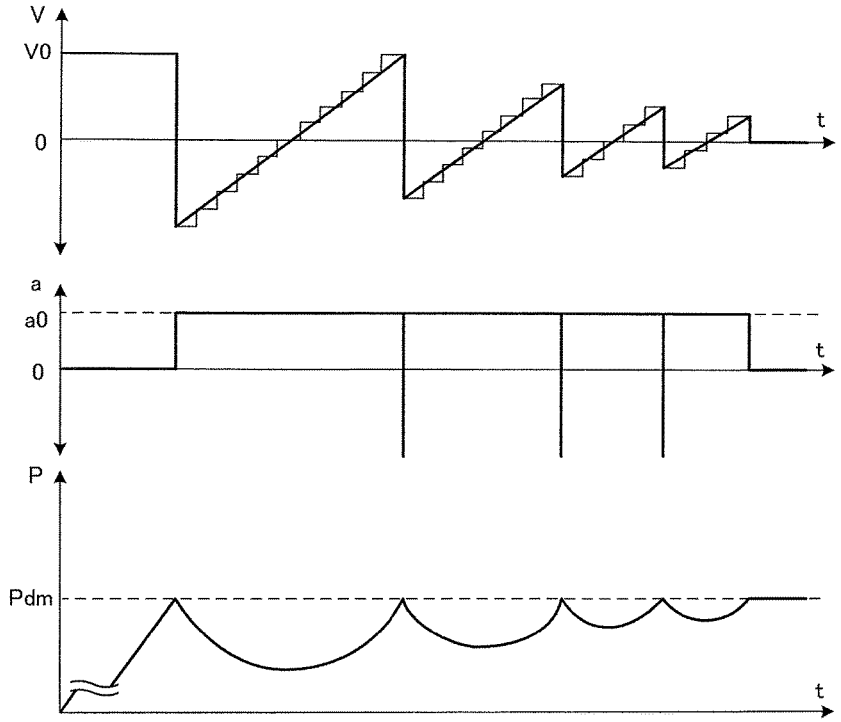
FIG. 3A illustrates the minute hand of the analog electronic timepiece according to the first embodiment during a rapid shift.
FIG. 3B is a table showing examples of parameters for backlash setting and damping setting.

FIG. 3A illustrates the minute hand 3 of the analog electronic timepiece 1 according to this embodiment during the rapid shift.

With reference to FIG. 3A, the hands 2 and 3 rapidly shift at a predetermined rapid shift rate until the current position P matches the target position (set position Pdm of the hands 2 and 3). The sign of the initial velocity V0 of the hands 2 and 3 is inverted at the target position such that the hands 2 and 3 rapidly shift in the opposite direction at a velocity V. Subsequently, the velocity V of the rapid shift is accelerated at a constant rate a=a0 (i.e., decelerated as the hands move away from the target position); the sign of the velocity (shifting direction) is inverted at a position that is $V0^2/2$ (predetermined distance) from the set position Pdm; and the hands 2 and 3 return to the set position Pdm while the velocity is accelerated toward the set position Pdm. As a result, the minute hand 3 (hour hand 2) returns to the set position Pdm at a velocity equal to the initial velocity V0. At the set position Pdm, the minute hand 3 (hour hand 2) shifts in the opposite direction at an initial velocity V0(1)=r×V0 determined by multiplying the initial velocity V0 with the coefficient of restitution r (0−r<1, damping rate). The velocity varies stepwise at predetermined updating intervals dt. The actual velocity undergoes a stepwise variation indicated by fine lines in the drawing. For the purpose of illustration, hereinafter the trend of the variation is schematically represented by only diagonal lines.

After N repeated bouncing movements, the initial velocity V0(N) after each bouncing movement gradually decreases to the (N)th power of the coefficient of restitution r. When the initial velocity V0(N) decreases to a value smaller than a predetermined reference value, the bouncing ends and the rapidly shifted hands 2 and 3 are stopped at the set position Pdm. In the drawing, the hands 2 and 3 are stopped after four bouncing movements because V0(5) is smaller than the reference value. A large coefficient of restitution r requires a long time until the hands 2 and 3 stops at the final target position, whereas a small coefficient of restitution r reduces the amplitude and frequency of the bouncing movement thereby reducing the visual effect of bouncing. Thus, the coefficient of restitution r should be appropriately determined in response to the first initial velocity V0 and other parameters.

For the determination of the coefficient of restitution r, the ROM 47 preliminarily stores damping setting 472 containing parameters associated with the damped bouncing movement.

FIG. 3B is a table showing example values for backlash setting 471 and damping setting 472.

With reference to FIG. 3B, the backlash setting 471 contain the number of backlash steps Bm for the turning of the minute hand 3 and the number of backlash steps Bh for the turning of the hour hand 2 in cooperation with the minute hand 3. The damping setting 472 contain the acceleration a0, the updating intervals dt of velocity, and the coefficient of restitution r.

These parameters are applied to update the velocity Vp to a velocity $V=Vp-a0\times dt$ at each updating interval dt within the bouncing cycle. After the (N)th bouncing movement, the initial velocity is $V0(N)=V0\times r^N$.

Figure 4:
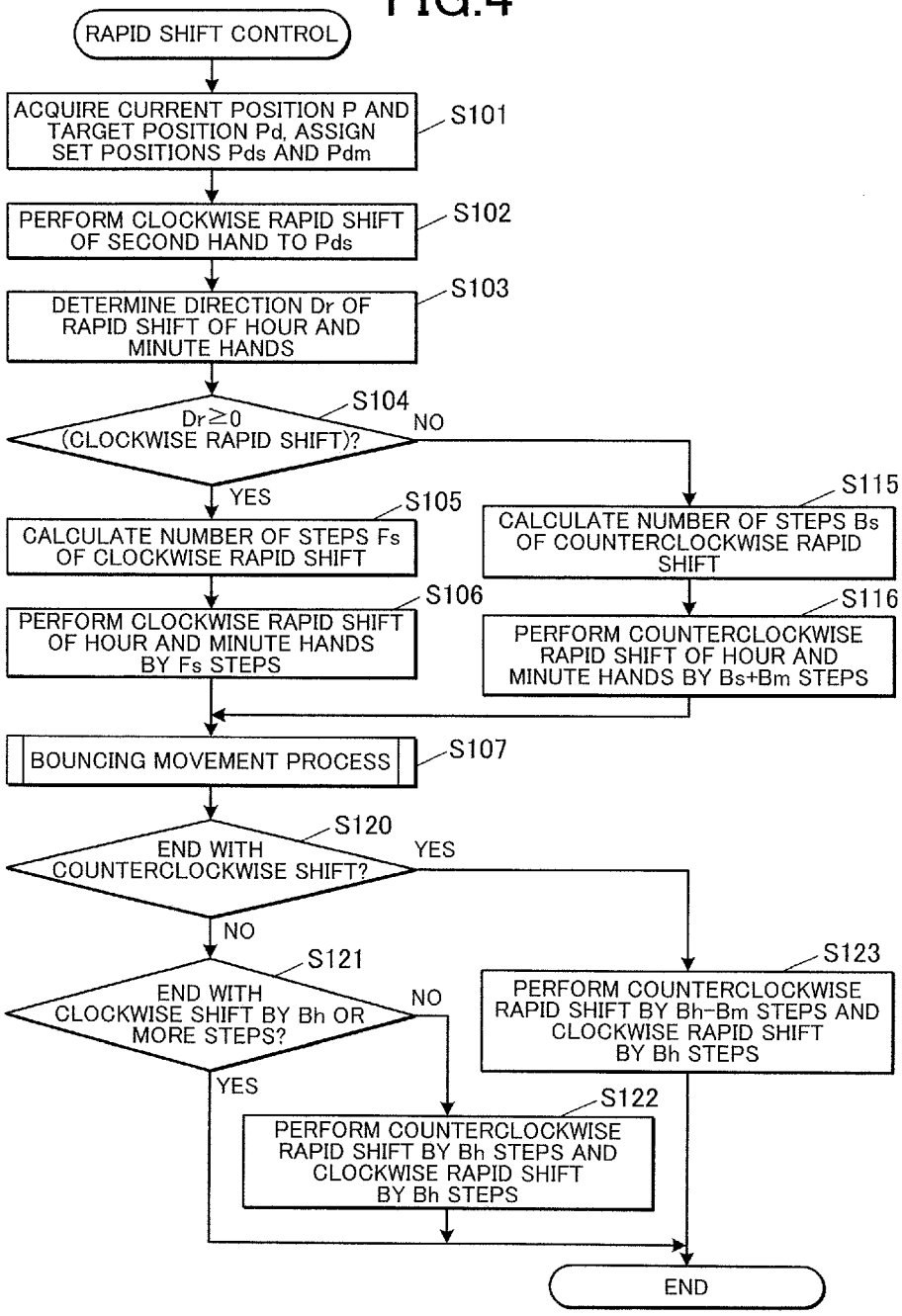
FIG. 4 is a flow chart illustrating the control process of rapid shift of hands of the analog electronic timepiece according to the first embodiment.

FIG. 4 is a flow chart illustrating the control process carried out by the CPU 46 for rapid shift control of the hands of the analog electronic timepiece 1 according to this embodiment.

The rapid shift control is automatically called up and executed during the rapid shift of the hands on the basis of predetermined parameters and/or conditions.

The CPU 46 acquires the current position P and the target position Pd or destination of the rapid shift and establishes a set position Pds of the second hand and a set position Pdm of the hour hand corresponding to the target position Pd (Step S101). The CPU 46 outputs a control signal to the driver circuit 49 and rapidly shifts the second hand 4 in the clockwise direction to the set position Pds at a maximum velocity (Step S102).

The rapid shift is performed at a maximum possible velocity, i.e., 200 pps in every case, unless specified. After the output of the control signal for the rapid shift to the driver circuit 49, the CPU 46 can carry out the next step before the end of the actual rapid shift of the hands, unless multiple rapid shift processes are simultaneously carried out.

The CPU 46 compares the current position P with the target position Pd and determines the direction Dr of the rapid shift of the hands 2 and 3 (Step S103). With the direction Dr of the rapid shift, the value "+1" is assigned to the clockwise direction and the value"−1" to the counterclockwise direction. The number of steps for the rapid shift movement across the hand position "0" may be calculated through an appropriate increase or decrease in the number of steps in one cycle, or the appropriate turning direction may be selected in consideration of information on the date, for example.

The CPU 46 determines whether the determined direction Dr of the rapid shift is 0 or larger, i.e., clockwise rapid shift (Step S104) If Dr is 0 or larger (clockwise shift) (YES in Step S104), the CPU 46 calculates the number of steps Fs for clockwise rapid shift on the basis of the difference between the set position Pdm and the current position P (Step S105). If the number of steps for clockwise rapid shift is already determined in Step S103, this number may be assigned as the number of steps Fs for clockwise rapid shift. If the hand passes through the position corresponding to 12:00 during the clockwise rapid shift or if the difference has a negative value, numeric value "4320" is added to the difference. The CPU 46 outputs a control signal to the driver circuit 49 and rapidly shifts the hour hand 2 and the minute hand 3 in the clockwise direction by Fs steps (Step S106). The CPU 46 then carries out Step S107.

In Step S104, if the direction Dr of the rapid shift is less than 0 or is not a clockwise rapid shift, is counterclockwise rapid shift) (NO in Step S104), the CPU 46 calculates the number of steps Bs (>0) for the counterclockwise rapid shift on the basis of the difference between the current position P and the set position Pdm (or acquires the value determined for comparison in Step S103) (Step S115). If the hands pass through the position corresponding to 0:00 during the counterclockwise rapid shift or if the difference has a negative value, numeric value "4320" may be added to the difference. The CPU 46 outputs a control signal to the driver circuit 49 and rapidly shifts the hour hand 2 and the minute hand 3 in the counterclockwise direction by Bs+Bm steps (Step S116). The CPU 46 then carries out Step S107.

The CPU 46 calls up and executes the bouncing movement process described below (Step S107). The CPU 46 determines whether the bouncing movement process ended in a counterclockwise movement, i.e., whether the last movement was a counterclockwise movement (Step S120). If the process did not end in a counterclockwise movement (ended in a clockwise movement) (NO in Step S120), the CPU 46 determines whether the bouncing movement process ended after shifting of the hands by the number of backlash steps Bh or more during the last clockwise movement in the bouncing movement process (Step S121). If the process ended after the shifting of the hands by the number of backlash steps Bh or more (YES in Step S121), the CPU 46 ends the rapid shift control. If the process ended without the shift of the hour hand by the number of backlash steps Bh or more (NO in Step S121), the CPU 46 sends a control signal to the driver circuit 49, carries out control for the rapid shift of the hour hand 2 and the minute hand 3 by the number of backlash steps Bh in the counterclockwise direction (the hour hand 2 does not always shift by the number of backlash steps Bh in actual cases), and shifts the hour hand 2 and the minute hand 3 by the number of backlash steps Bh in the clockwise direction, to remove the allowance of the gear train mechanism 32 in the clockwise direction for the turning of the hour hand 2 and the minute hand 3 (Step S122). The CPU 46 then ends the rapid shift control.

In Step S120, if the bouncing movement ended in a counterclockwise movement (YES in Step S120), the CPU 46 rapidly shifts the hour hand 2 and the minute hand 3 by the number of steps equal to the difference Bh-Bm of the number of backlash steps Bh and the number of backlash steps Bm in the counterclockwise direction and then by the number of backlash steps Bh in the clockwise direction, to remove the allowance of the gear train mechanism 32 in the clockwise direction for the turning of the hour hand 2 and the minute hand 3 (Step S123). The CPU 46 then ends the rapid shift control.

Figure 5:
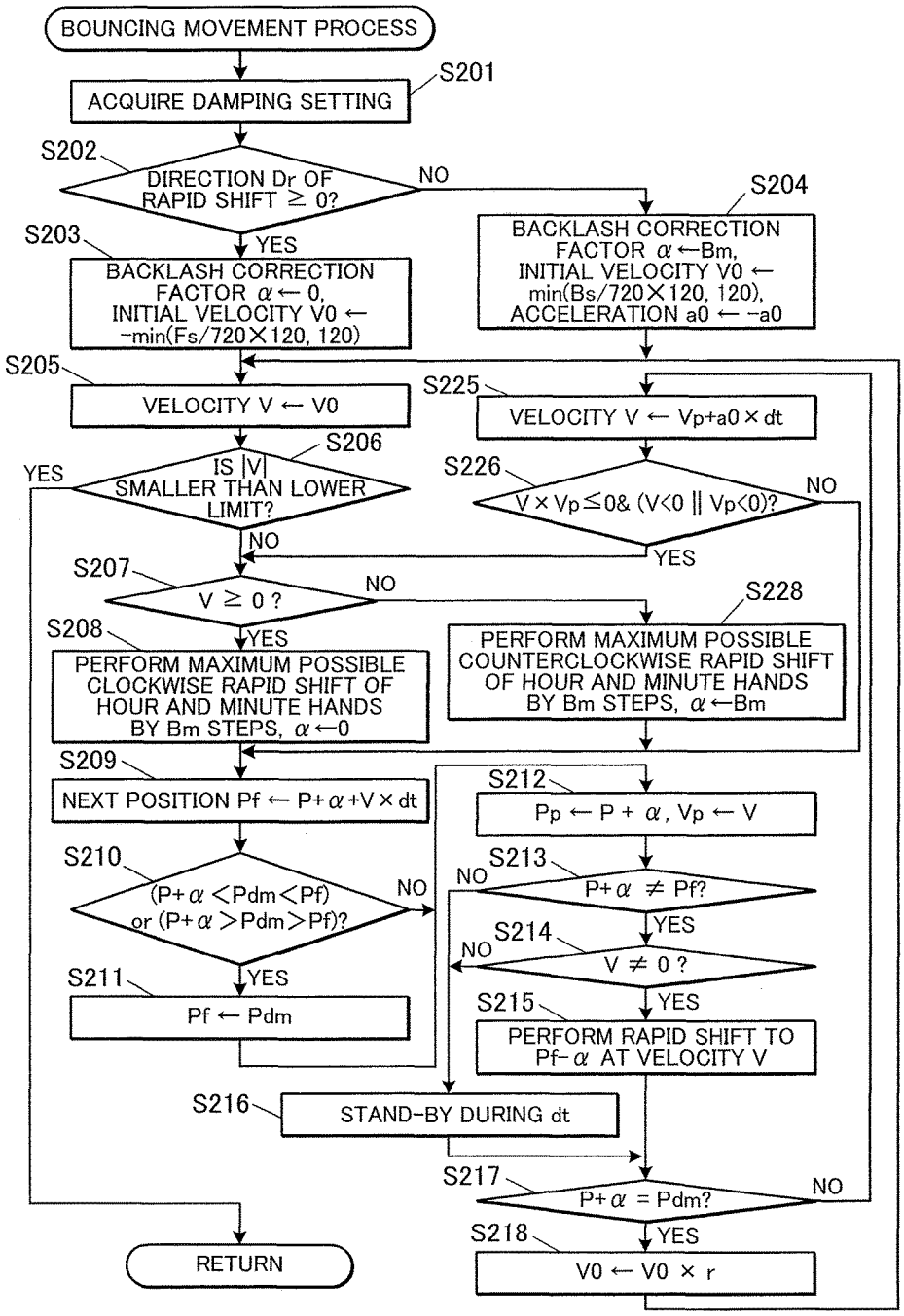
FIG. 5 is a flow chart illustrating the control process of a bouncing movement called up during rapid shift control.

FIG. 5 is a flow chart illustrating the control process of the bouncing movement called up by the CPU 46 during the rapid shift control. The bouncing movement process is an example of reciprocation damping control according to an embodiment of the present invention. The reciprocation damping control continues after the hands 2 and 3 reach the target position of the rapid shift.

Upon call-up of the bouncing movement process, the CPU 46 acquires the damping setting 472 from the ROM 47 (Step S201). In detail, the CPU 46 acquires the updating intervals dt, the acceleration a0, and the coefficient of restitution r.

The CPU 46 determines whether the direction Dr of the rapid shift under the rapid shift control is 0 or larger, i.e., whether the hands rapidly shift in the clockwise direction (Step S202). If the direction Dr of the rapid shift is 0 or larger (the hands rapidly shift in the clockwise direction) (YES in Step S202), the CPU 46 assigns numeric value "0" to the backlash correction factor $\alpha$ and assigns the sign-inverted value of smaller one of $Fs/720\times120$ and 120 (i.e., a negative value) to the initial velocity V0 of the bouncing movement (Step S203). Alternatively, the CPU 46 may determine whether the number of steps Fs of clockwise shift is 720 or more. If the number of steps Fs is 720 or more, the CPU 46 assigns numeric value "−120" to the initial velocity V0, whereas if the number of steps Fs is less than 720, it calculates the initial velocity, $-1\times Fs/720\times120$. That is, the initial velocity V0 is a value having an upper limit determined on the basis of the number of steps in rapid shift (distance of rapid shift). The CPU 46 then carries out Step S205.

If the direction Dr of the rapid shift is not 0 or larger, i.e., if the rapid shift is not clockwise (is counterclockwise) (NO in Step S202), the CPU 46 assigns the number of backlash steps Bm to the backlash correction factor α, assigns the smaller one of Bs/720×120 and 120 to the initial velocity V0 of the bouncing movement, and inverts the sign of the acceleration a0 (i.e., multiplies by −1) (Step S204). Alternatively, the CPU 46 may determine whether the number of backlash steps Be is 720 or more. If the number of backlash steps Be is 720 or more, the CPU 46 assigns numeric value "120" to the initial velocity, whereas if less than 720, it assigns Fs/720×120 to the initial velocity. The backlash correction factor α corresponds to the difference between the current position P in counterclockwise shifting and the position actually indicated by the hands 2 and 3 (actual position). The CPU 46 then carries out Step S205.

In Step S205 carried out after Step S203 or S204, the CPU 46 assigns the initial velocity V0 to the velocity V of rapid shift (Step S205). The assigned velocity V should be a value (for example, an integer) corresponding to a velocity at which the stepping motor 42 is operable in response to the driving signal from the driver circuit 49. If a velocity V at which the stepping motor 42 is inoperable is assigned in this step or in the subsequent steps, the CPU 46 should select a velocity closest to the assigned value or a maximum possible velocity smaller than the assigned value for the velocity V. The CPU 46 determines whether the absolute value |V| of the velocity V is smaller than a predetermined lower limit (Step S206). If the absolute value |V| is smaller than the lower limit (YES in Step S206), the CPU 46 ends the bouncing movement process and returns to the rapid shift control.

If the absolute value |V| is not smaller than the lower limit (NO in Step S206), the CPU 46 determines whether the velocity V is 0 or larger (Step S207). If the velocity V is determined to be 0 or larger (YES in Step S207), the CPU 46 outputs a control signal to the driver circuit 49 and rapidly shifts the hour hand 2 and the minute hand 3 in the clockwise direction by the number of backlash steps Bm at a maximum possible rapid shift rate. The CPU 46 assigns numeric value "0" to the backlash correction factor α (Step S208). The CPU 46 then carries out Step S209.

In Step S207, if the velocity V is less than 0 (NO in Step S207), the CPU 46 outputs a control signal to the driver circuit 49 to rapidly shift the hour hand 2 and the minute hand 3 by the number of backlash steps Bm in the counterclockwise direction at a maximum possible rapid shift rate. The CPU 46 assigns the number of backlash steps Bm to the backlash correction factor α (Step S228). The CPU 46 then carries out Step S209.

In Step S209, the CPU 46 determines Pf=P+α+V×dt for the next target position (next position Pf), where P is the current position, α is the backlash correction factor, V is the velocity, and dt is the updating interval (Step S209). That is, the next position Pf is the sum of the current position P and the distance of shift during the updating interval dt. The next position Pf indicates the actual position of the hands. The CPU 46 determines whether the next position Pf and the set position Pdm of the hour and minute hands satisfy (P+α<Pdm<Pf) or (P+α>Pdm>Pf) (Step S210). If this relationship is satisfied (YES in Step S210), i.e., if the hands rapidly shifted from the current position P to the next position Pf pass through the set position Pdm, the CPU 46 updates the next position Pf to the set position Pdm (Step S211). The CPU 46 then carries out Step S212. If the relationship is not satisfied (NO in Step S210), the CPU 46 carries out Step S212.

In Step S212, the CPU 46 assigns the current position P to the previous position Pp and the velocity V to the previous velocity Vp (Step S212). The CPU 46 determines whether the position corresponding to the sum of the current position P and the backlash correction factor α differs from the next position Pf (Step S213). If the positions match (NO in Step S213), the CPU 46 carries out Step S216. If the positions differ (YES in Step S213), the CPU 46 determines whether the velocity V is "0" (Step S214). If the velocity V is "0" (NO in Step S214) the CPU 46 carries out Step S216. If the velocity V is not "0" (YES in Step S214), the CPU 46 outputs a control signal to the driver circuit 49 to rapidly shift the hands 2 and 3 at the velocity V to the position (Pf−α) determined by subtracting the backlash correction factor α from the next position Pf (Step S215). The CPU 46 then carries out Step S217.

In Step S216, the CPU 46 enters a stand-by mode during the updating interval dt without shift of the hands 2 and 3 (Step S216). The CPU 46 then carries out Step S217.

In Step S217, the CPU 46 determines whether the position corresponding to the sum of the current position P and the backlash correction factor α matches the set position Pdm (Step S217). If the sum does not match the set position Pdm (NO in Step S217), the CPU 46 updates the velocity V (Step S225). The updated velocity V is determined by V=Vp+a0×dt. That is, the current velocity V is calculated by adding the variation in the velocity due to the acceleration a0 during the updating interval dt to the previous velocity Vp. The CPU 46 determines whether the product of the velocity V and the previous velocity Vp is 0 or less and whether at least one of the velocity V and the previous velocity Vp IS less than 0 (Step S226). That is, the CPU 46 determines whether the sign of the velocity is inverted between the previous velocity Vp to the velocity V by determining whether the velocity has switched from 0 or more to less than 0 or vice versa. If this condition is satisfied (if the sign is inverted) (YES in Step S226), the CPU 46 carries out Step S207. If this condition is not satisfied (if the sign is not inverted) (NO in Step S226), the CPU 46 carries out Step S209.

In Step S217, if the sum matches the set position Pdm (YES in Step S217), the CPU 46 updates the initial velocity V0 to the product of the initial velocity V0 and the coefficient of restitution r (Step S218). The CPU 46 then carries out Step S205.

FIGS. 6A to 6F and FIGS. 7A to 7C illustrate specific example positions of the hands during the rapid shift control of the analog electronic timepiece 1 according to this embodiment.

The shift of the hands from the time display 7:23:40 illustrated in FIG. 6A to 9:30:08 will now be described.

Figure 6A:
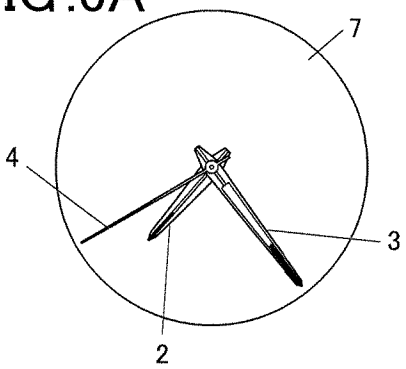
FIGS. 6A to 6F illustrate specific examples of the shifting of the hands of the analog electronic timepiece according to the first embodiment during a rapid shift control.
Figure 6B:
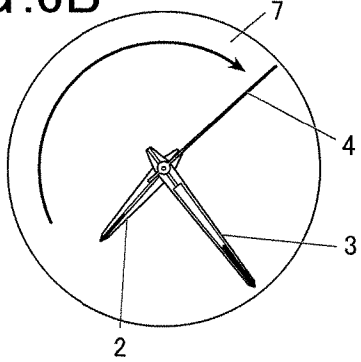
Figure 6C:
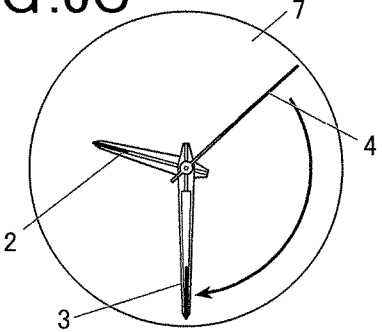
Figure 6D:
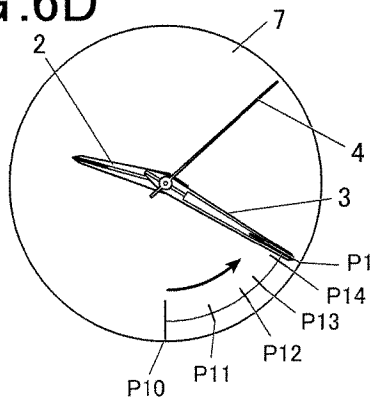

Numeric values "8" and "3420" are assigned to the set positions Pds and Pdm, respectively (Step S101) and the second hand 4 rapidly shift in the clockwise direction to the 8-second position (Step S102) (see FIG. 6B). The current position P ("2662") of the hands is compared with the set position Pdm ("3420"), and the direction Dr of the rapid shift of the hands 2 and 3 is determined to be a positive value ("+1"), i.e., clockwise rapid shift (Step S103). Thus, the hands 2 and 3 are rapidly shifted by 778 steps (Steps S104 and S105). With reference to FIG. 6C, the hands 2 and 3 rapidly shift to the set position Pdm, i.e., the position corresponding to 9:30 (from 0 to 9 seconds) (Step S106), and then the bouncing movement process starts (Step S107).

In the first bouncing movement, the damping setting 472 are acquired (Step S201), the numeric value "0" is assigned to the backlash correction factor α in response to the clockwise rapid shift, and the numeric value "−120" is assigned to the initial velocity V0 of the bouncing in response to the number of steps in rapid shift larger than 720 (Steps S202 and S203). The initial velocity V0=−120 is assigned to the velocity V (Step S206). If the lower limit of the |V| is "25," the process goes to NO in Step S206. The negative velocity V (NO in Step S207) causes the hands 2 and 3 to rapidly shift in the counterclockwise direction by the backlash steps Bm such that the hands shift to the counterclockwise side of the minute hand 3 and the backlash steps Bm=2 is assigned to the backlash correction factor α (Step S228). Thus, at this point, the current position P corresponds to the numeric value "3418" and the actual position (P+α) of the hands 2 and 3 corresponds to the numeric value "3420."

The next position Pf is determined to correspond to the numeric value "3400" on the basis of the current position P ("3418"), the backlash correction factor α ("2"), the velocity V ("−120"), and the updating interval dt ("⅙") (Step S209). The CPU 46 determines whether the set position Pdm ("3420") is between the actual position (P+α) of the hands and the next position Pf (without including both ends) (Step S210) Since the set position Pdm matches the actual position (P+α), the set position Pdm is not between the positions (P+α) and Pf (NO in Step S210).

The current position P is assigned to the previous position Pp; the velocity V is assigned to the previous velocity VP (Step S212); the actual position (P+α) is determined not to match the next position Pf (YES in Step S213); and the velocity V is determined not to be "0" (YES in Step S214). The hands then rapidly shift at the velocity V in the counterclockwise direction to the position (Pf−α) calculated by the driver circuit 49, i.e., the position corresponding to the numeric value "3398" (Step S215). This shifts the minute hand 3 from the position P10 (30 minutes 0 seconds) in FIG. 6D to the position P11 (26 minutes 40 seconds) during the updating interval dt. When the minute hand 3 shifts to the position P11, the actual position (P+α) of the hands 2 and 3 matches the next position Pf.

The hour hand 2 shifts in cooperation with the turning of the minute hand 3 but also idles for four steps, which is the difference of between the backlash steps Bm and the backlash steps Bh. Thus, the hour hand 2 turns by approximately 4.67 degrees in the counterclockwise direction for the 60 degrees of rotation of the minute hand 3 corresponding to the 60 steps, where 4.67 degrees is determined by subtracting the difference (4 steps) from the 60 steps to obtain 56 and dividing this by 12. The idling of the hour hand 2 for the steps corresponding to the difference also occurs during the clockwise shift. The idling of the hour hand 2, however, is cancelled out during a single bouncing movement so long as the hour hand 2 shifts in the clockwise direction by at least the number of backlash steps Bh. Thus, hereinafter, the shift of only the minute hand 3 will be described, unless otherwise specified.

Since the set position Pdm and the actual position (P+α) do not match during the first movement at the velocity V (NO in Step S217), the CPU 46 carries out Step S225 to vary the velocity V of the hands 2 and 3. The numeric value "96" is assigned to the next velocity V on the basis of the previous velocity VP ("120"), the acceleration a0 ("144"), and the updating interval dt ("⅙") (Step S225). The previous velocity Vp and the current velocity V are both positive values, in the same direction. Thus, the process goes to NO in Step S226. In Step S209, the numeric value "3384" is assigned to the next position Pf. The subsequent Steps S210 to S215 are repeated, and the minute hand 3 shifts to the position P12 (24 minutes 0 seconds).

While the Steps S225, S226, S207, S228, S209, S210, S212 to S215, and S217 are repeated, the minute hand 3 shifts to the position P13 (22 minutes 0 seconds), the position P14 (20 minutes 40 seconds), and the position P15 (20 minutes 0 seconds), while the distance of shift decreases during each updating interval dt, i.e. the velocity V gradually decreases. The numeric value "0" is assigned to the velocity V after the minute hand 3 reaches the position P15 (i.e., P+α=3360 and P=3358) (Step S225). That is, the position P15 is the furthest position of the hands 2 and 3 in the counterclockwise direction during the first bouncing movement (return position). The hour hand 2, however, shifts four steps, which is the difference between the number of backlash steps Bh and the number of backlash steps Bm, forward of 9:20, as described above.

V×Vp=0 and Vp<0 hold because the velocity V is 0 in Step S225. Thus, the process goes to YES in Step S226. The process then goes to YES in Step S207, and the hands 2 and 3 rapidly shift by the backlash steps Bm(2) in the clockwise direction. The hands 2 and 3 do not move, and the gear train mechanism 32 of the minute hand 3 turns to achieve a clockwise rotation. The numeric value "0" is assigned to the backlash correction factor α, and the current position P and the actual position (P+α) both correspond to the numeric value "3360" (Step S208).

Figure 6E:
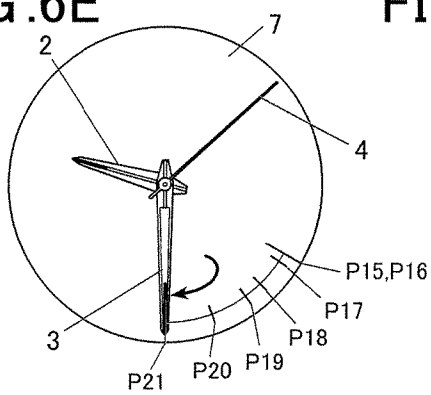

In the repeated process of Steps S225 to S217, the next position Pf corresponds to the numeric value "3360" and matches the actual position (P+α) (NO in Steps S209 and S213), and the hands 2 and 3 enter stand-by mode during the updating interval dt at the position P16, which is the same as the position P15, as illustrated in FIG. 6E (Step S216).

In the next repeated process, the numeric value "24" is assigned to the velocity V, inverting the velocity V to a positive value (Step S225). Thus, the numeric value "3364" is assigned to the next position Pf (Step S209), and the minute hand 3 returns to the position P17 in the clockwise direction (Step S210 and Steps S212 to S215). Similarly, through this repeated process, the velocity V in the clockwise direction increases and the distance of shift during the updating interval dt increases while the minute hand 3 sequentially pass through the position P18 (22 minutes 0 seconds), the position P19 (24 minutes 0 seconds), and the position P20 (26 minutes 40 seconds).

Figure 6F:
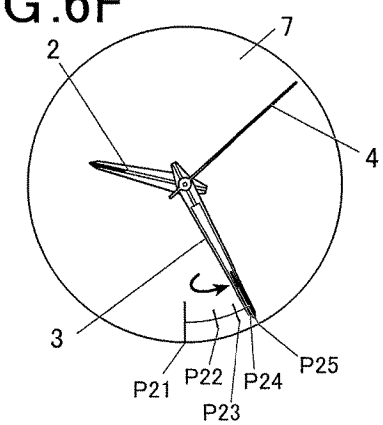
Figure 7A:
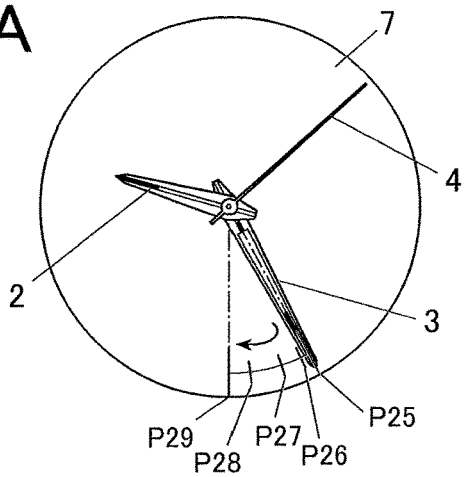
Figure 7B:
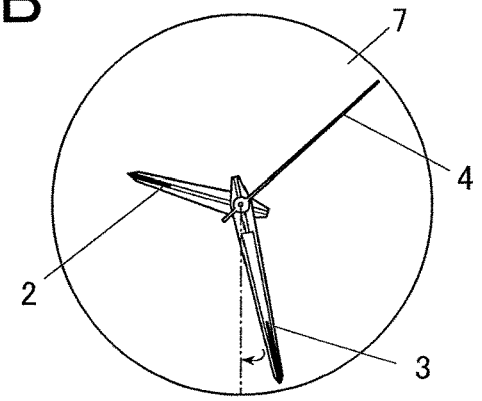

In the repeated process after the minute hand 3 reaches the position P20, the numeric value "120" is assigned to the velocity V (Step S225), the numeric value "3420" is assigned to the next position Pf (Step S209), and the hands 2 and 3 return to the set position Pdm (Step S215) Thus, P+α=Pdm holds (YES in Step S217), and the initial velocity V0 decreases due to the coefficient of restitution r (Step S218). In detail, the numeric value "−96" is assigned to the initial velocity V0. The process returns to Step S205, and the minute hand 3 rapidly shifts while decelerating in the counterclockwise direction from the position P21 (30 minutes 0 seconds) to the position P25 (25 minutes 20 seconds) through the positions P22, P23, and P24, as illustrated in FIG. 6F. With reference to FIG. 7A, the minute hand 3 rapidly shifts while accelerating in the clockwise direction from the position P25 (25 minutes 20 seconds) to the position P29 (30 minutes 0 seconds) through the positions P26, P27, and P28. Since the initial velocity V0 in the second bouncing movement is smaller than that in the first bouncing movement, the position at which the hands 2 and 3 stop and move in the opposite direction (return position "3140") is disposed closer to the set position Pdm ("3420") in the second bouncing movement than that in the first bouncing movement, and the process for determining the inversion of the sign of the velocity in Step S226 is repeated one less time, i.e., 5 times.

In Step S215, the minute hand 3 reaches the position P28 (28 minutes 50 seconds, P+α=3413), and then the numeric value "90" is assigned to the next velocity V determined in Step S225. The next position Pf determined to be the numeric value "3428" (Step S209) passes through the set position Pdm (YES in Step S210). Thus, the set position Pdm ("3420") is assigned to the next position Pf (Step S211).

Figure 7C:
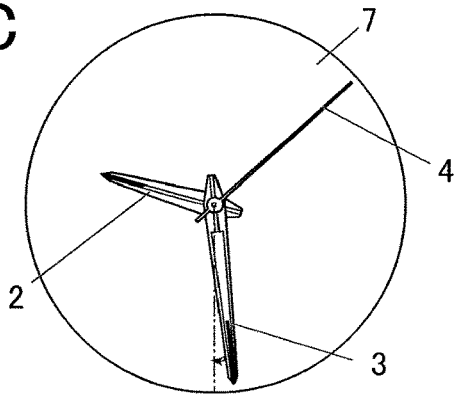

Similarly, the minute hand 3 and the hour hand 2 repeat the bouncing movement in the counterclockwise direction from the set position Pdm (9:30 position) while gradually reducing its amplitude. The return position of the minute hand 3 in the third bouncing movement is the position of 28 minutes 0 seconds (P+α=3408), as illustrated n FIG. 7B, and the return position of the minute hand 3 in the fourth bouncing movement is the position of 29 minutes 0 seconds (P+α=3414), as illustrated in FIG. 7C.

The initial velocity V0 gradually decreases through such repeated bouncing movement. When the initial velocity V0 reaches −21 in Step S218, which is the final step in the repeated process of Step S205 through Step S218 for the fourth bouncing movement, the absolute value |V| of the velocity V established in Step S205 falls below the lower limit "25" (YES in Step S206). The bouncing movement then ends.

In the fourth bouncing movement, the difference between the set position Pdm ("3420") and the return position ("3414") of the minute hand 3 is six steps, i.e., the bouncing movement ends in a clockwise movement by a number of steps equal to the number of backlash steps Bh (6 steps) (YES in Step S121). Thus, the rapid shift control ends in this step.

As described above, the analog electronic timepiece 1 according to the first embodiment includes a turnable hour hand 2 and a turnable minute hand 3 (primary hand) and a CPU 46 that controls the turning of the hands 2 and 3. The CPU 46 controls the damping of reciprocation during rapid shift of the hour hand 2 and the minute hand 3 to a predetermined target (set position Pdm), to gradually reduce the magnitude of the reciprocation (bouncing) of the hands 2 and 3 with reference to the target position.

Instead of the hands 2 and 3 simply reaching the target position of rapid shift, the hands 2 and 3 repeatedly bounce within a range across the set position Pdm before reaching the target position to enable sensuous perception of the arrival of the rapidly shifted hands 2 and 3 to the target position by the user. The reciprocation through the reference or set position Pdm reduces the risk of misreading of the approximate position of the hands by the user.

The CPU 46 continues to control the damping of reciprocation of the hands 2 and 3 at the target position. In detail, the hands 2 and 3 quickly shift to the target position and then reciprocate while the shifting is damped. Thus, the user can readily perceive the target position or at least estimate the approximate target position.

The predetermined reciprocation includes a bouncing movement in which the hands 2 and 3 that reach the target position in a predetermined incident direction (from upstream of the clockwise turning movement) invert the moving direction in the opposite direction at the target position, and shift in this direction for a predetermined distance. The CPU 46 controls the damping of the reciprocation by repeating the bounding movement while reducing the predetermine distance.

The bouncing of the hands 2 and 3 at the target position promotes reading of the target position of the hands 2 and 3 during the reciprocation damping control. Since the hands 2 and 3 shift mainly on one side of the target position, information including the direction of the rapid shift of the hands 2 and 3 can be sensuously perceived by the user.

Since the predetermined incident direction is identical to the direction of rapid shift of the hands 2 and 3, information on the direction of rapid shift of the hands 2 and 3, for example, can be readily and appropriately provided, as described above. That is, when the hands reach the target position after rapid shift or when the hands return to the target position after bouncing, the hands always bounce multiple times toward the upstream of the rapid shift, unless the velocity of the bouncing falls below a predetermined reference velocity.

The CPU 46 determines the magnitude of the movement at the beginning of predetermined reciprocation, i.e., the destination and velocity of bouncing, on the basis of the distance of rapid shift of the hands 2 and 3. Thus, the user can acquire comprehensive information on the rapid shift without actually observing the entire duration of the rapid shift.

During the predetermined reciprocation, the CPU 46 varies the velocity of the hands 2 and 3 in response to the positive acceleration of the hands 2 and 3 with respect to the moving direction from the original position to the target position (set position Pdm). Specifically, the hands 2 and 3 reciprocate in such a manner that the hands 2 and 3 appear to be attracted to the target position. This achieves a comfortable reciprocation movement and promotes ready recognition of the target position by the user.

The CPU 46 gradually decreases the magnitude of the movement in every cycle of the reciprocation. This achieves a simplified movement without much awkwardness in the reciprocation. Thus, simple reciprocation damping control can be performed to reduce processing load.

The hands include a minute hand 3 and a hour hand 2 that turns in cooperation with the minute hand 3 at a rotational angle smaller than that of the minute hand 3. The target position is determined by the combination of the positions of the minute hand 3 and the hour hand 2. A mechanism that turns multiple hands in cooperation should rapidly shift all of the hands to the target position. Thus, the time required for the rapid shift is often large. In such a case, the CPU 46 controls the damping of the reciprocation of the hands 2 and 3 instead of simply shifting the hands 2 and 3 to the target position, to reduce the sense of discomfort caused by being unaware of the completion of the rapid shift. While the minute hand 3 mainly reciprocates through damping control, the hour hand 2 does not largely shift. Thus, such driving of the hands can appropriately and readily indicate the target position even during reciprocation damping control.

In particular, in switching the local time such as a time zone, the difference in time is rarely less than one hour, and a time difference less than one hour is in units of 15 minutes. Thus, the precise time does not have to be indicated for the quick display of time. This achieves ready presentation of necessary information and effective display of the end of rapid shift and/or additional information on the rapid shift.

Second Embodiment

An analog electronic timepiece 1 according to a second embodiment will now be described.

The configuration of the analog electronic timepiece 1 according the second embodiment is identical to that of the analog electronic timepiece 1 according to the first embodiment Thus, the same reference signs will be used, and the descriptions thereof are omitted.

Figure 8:
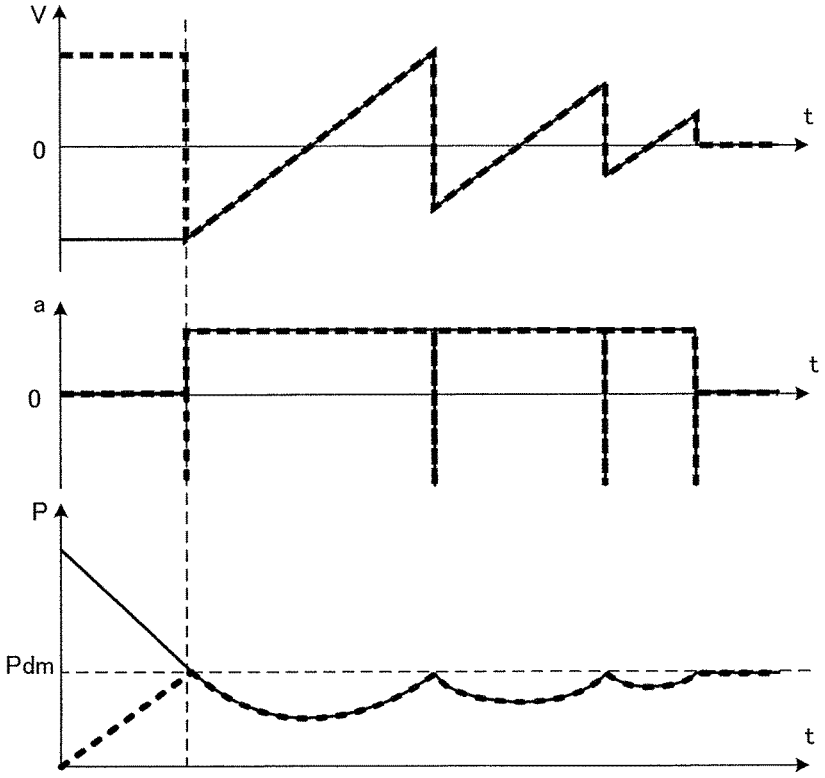
FIG. 8 illustrates the minute hand of an analog electronic timepiece according to a second embodiment during a rapid shift.

FIG. 8 illustrates the shifting of the minute hand 3 of the analog electronic timepiece 1 according to this embodiment during a rapid shift operation.

The analog electronic timepiece 1 according to this embodiment always bounces in the counterclockwise direction.

When the hands 2 and 3 reach the set position Pdm at a rapid shift velocity V≥0 (clockwise rapid shift in a predetermined incident direction), the hands 2 and 3 bounce at the set position Pdm in a manner similar to that in the first embodiment and return to the counterclockwise side, as indicated by the thick dotted line in the drawing. When the hands 2 and 3 reach the set position Pdm at a rapid shift velocity V<0 (counterclockwise rapid shift), the hands 2 and 3 pass through the set position Pdm while accelerating in the clockwise direction without bouncing (i.e., decelerating in the counterclockwise direction) and shift in the counterclockwise direction, as indicated by the solid line in the drawing. The hands 2 and 3 return to the set position Pdm at a sign-inverted or positive velocity and bounce toward the counterclockwise side. Such bouncing of the hands 2 and 3 toward the counterclockwise side (forward position) of the set position Pdm regardless of the direction of the rapid shift causes the hands 2 and 3 to finally rapidly shift in the clockwise direction to the set position Pdm. The assigned number of steps in the last rapid shift in the clockwise direction is larger than or equal to number of backlash steps Bh, to rotate the gear train mechanism 32 of the hands 2 and 3 in the clockwise direction. Thus, the elimination of backlash is not required.

Figure 9:
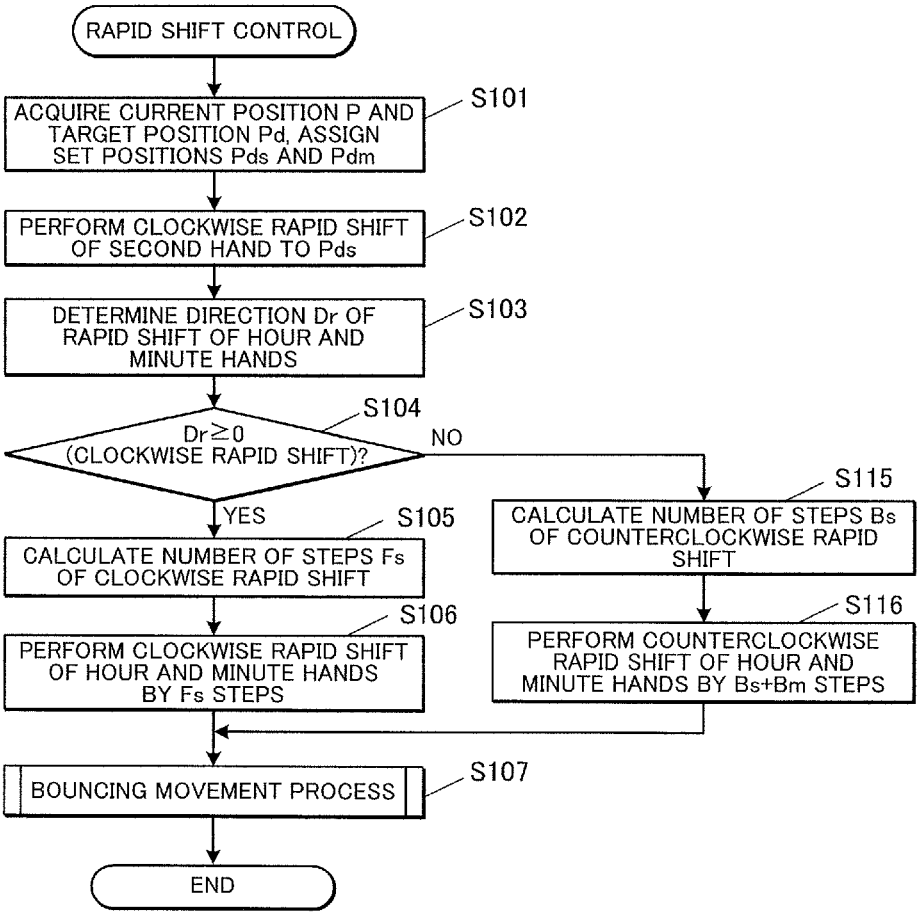
FIG. 9 is a flow chart illustrating the rapid shift control in the analog electronic timepiece according to the second embodiment.

FIG. 9 is a flow chart illustrating the rapid shift control carried out by the CPU 46 of the analog electronic timepiece 1 according to this embodiment. In the rapid shift control, Step S120 to S123 of the rapid shift control according to the first embodiment illustrated in FIG. 4 are omitted, and the bouncing movement process is called up and executed in Step S107, regardless of the direction of the rapid shift. The process then ends. The steps that are identical to those in the process illustrated in FIG. 4 are indicated by the same reference signs.

Figure 10:
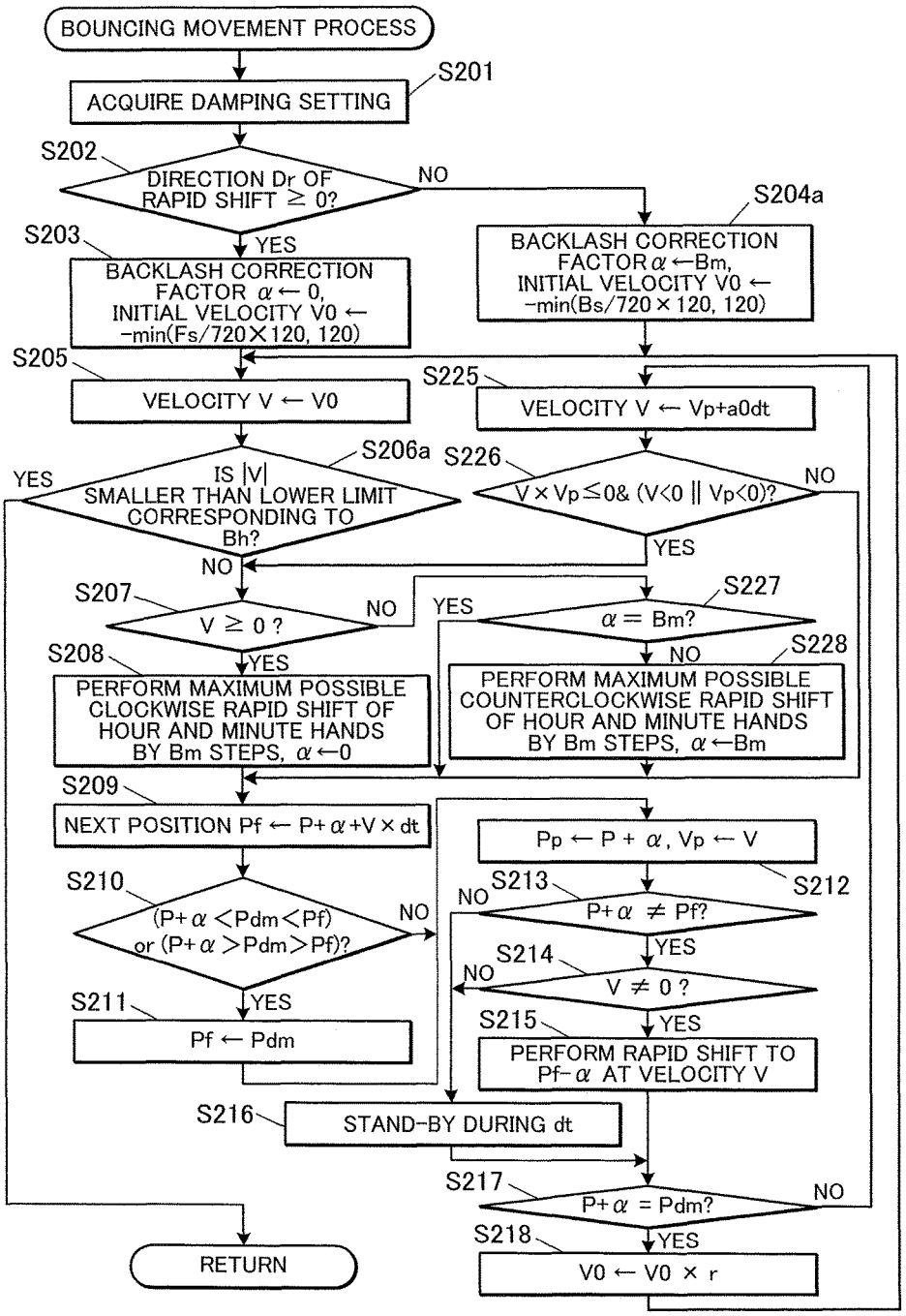
FIG. 10 is a flow chart illustrating the control process of a bouncing movement called up during the rapid shift control of the analog electronic timepiece according to the second embodiment.

FIG. 10 is a flow chart illustrating the bouncing movement control by the CPU 46 called up during the rapid shift control illustrated in FIG. 9.

This bouncing movement control is identical to that illustrated in FIG. 5, except that Steps S204 and S206 are replaced by Steps S204*a* and S206*a*, respectively, and Step 9227 is added immediately before Step S228. The steps that are identical are indicated by the same reference signs, and the descriptions thereof are omitted.

In Step S202, if the direction Dr of rapid shift is not 0 or more, i.e., not the clockwise direction (is the counterclockwise direction) (NO in Step S202), the CPU 46 assigns Bm to the backlash correction factor α and assigns the sign-inverted value (negative value) of the smaller one of Bm/720×120 and 120 to the initial velocity V0 of the bouncing (Step S204*a*). The CPU 46 then carries out Step S205.

After assigning the velocity V to the initial velocity V0 in Step S205, the CPU 46 determines whether the absolute value |V| of the velocity V is smaller than a predetermined lower limit determined in accordance with the number of backlash steps Bh (Step S206*a*). That is, if the lower limit is determined such that counterclockwise rapid shift and clockwise rapid shift are finally carried out for at least the number of backlash steps Bh even when the velocity V is equal to the lower limit and it bouncing is carried out at a velocity smaller than the initial velocity assigned in accordance with the lower limit (YES in Step 9206*a*), the CPU 46 ends the bouncing movement process.

In Step S207, if the velocity V is not larger than or equal to zero (NO in Step S207), the CPU 46 determines whether the backlash correction factor α is equal to the number of backlash steps Bm (Step S227). If the backlash correction factor α is equal to the number of backlash steps Bm (YES in Step S227), the CPU 46 carries out Step S209. If the backlash correction factor α (which is "0" in this step) is not equal to the number of backlash steps Bm (NO in Step S227), the CPU 46 carries out Step S228 and then Step S209.

In the analog electronic timepiece 1 according to the second embodiment, the CPU 46 controls the damping of reciprocation, such as bouncing, to rapidly shift the hands 2 and 3 in a predetermine direction of final shift to the target position and then end the rapid shift. The gradual damping of the magnitude of the reciprocation and the final rapid shift in a predetermined direction allow the user to sensuously perceive the end of the reciprocation damping control in a ready and appropriate manner.

The hands 2 and 3 are rotationally driven by the gear train mechanism 32, the direction of the final shift is determined to be the clockwise direction, and the CPU 46 controls the damping of reciprocation such that the number of steps in the final shift of the hands 2 and 3 driven by controlling the damping of reciprocation in the clockwise direction is at least the number of backlash steps Bh of the gear train mechanism 32. Thus, backlash elimination is not required for clockwise turning after the reciprocation damping control. In this way, the end of the rapid shift can be appropriately notified to the user in a comfortable manner.

Third Embodiment

An analog electronic timepiece 1 according to a third embodiment will now be described.

The configuration of the analog electronic timepiece 1 according the third embodiment is identical to that of the analog electronic timepiece 1 according to the first embodiment. Thus, the same reference signs will be used, and descriptions thereof are omitted.

Figure 11:
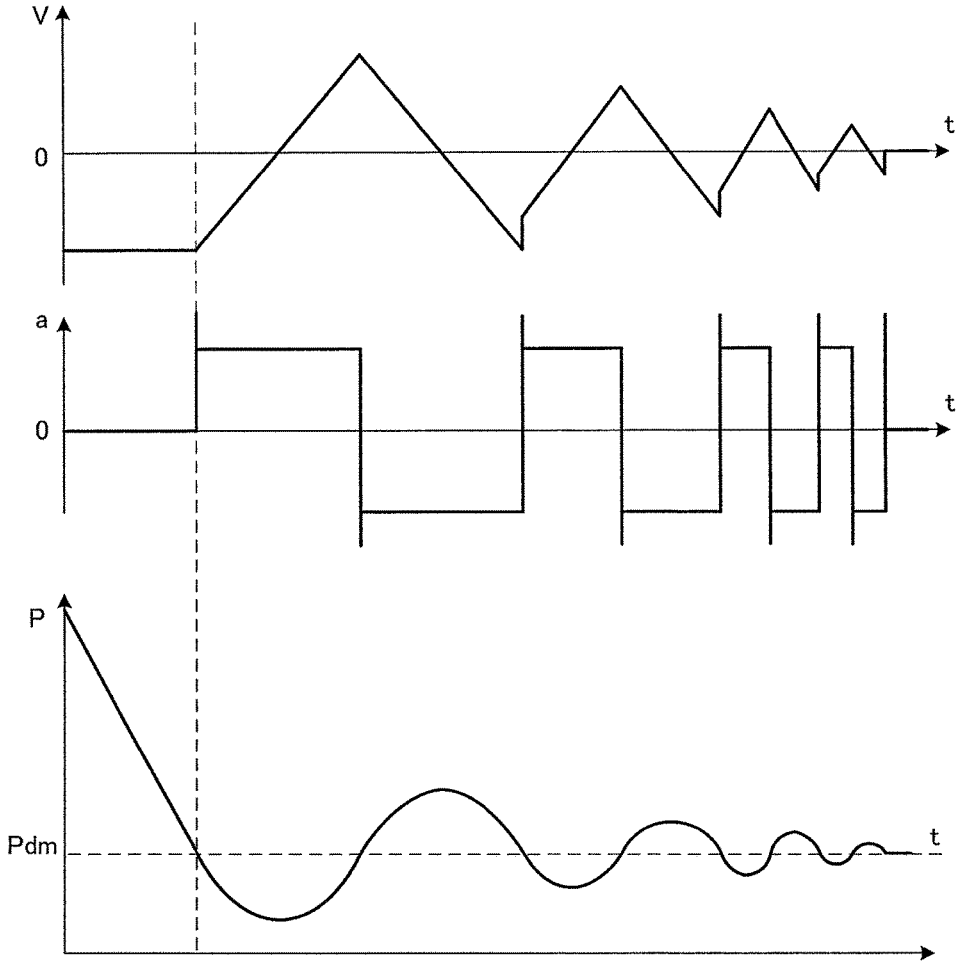
FIG. 11 illustrates the hour and minute hands of an analog electronic timepiece according to a third embodiment during rapid shift.

FIG. 11 illustrates the shifting of the hour and minute hands of the analog electronic timepiece 1 according to this embodiment during a rapid shift operation.

In the analog electronic timepiece 1 according to the third embodiment, the rapidly shifted hour and minute hands reach the set position Pdm and are damped about the center or set position Pdm, instead of a bouncing operation. In this process the coefficient of restitution r of the damping setting 472 corresponds to the damping rate of the initial velocity V0 per cycle, which is determined by comparing the initial velocity V0 with the initial velocity V0 of the previous cycle (a small damping rate indicates rapid damping).

The hands 2 and 3 that reach the set position Pdm pass through the set position Pdm and decrease their velocity at a constant deceleration rate, in a manner similar to the hands 2 and 3 of the analog electronic timepiece 1 according to the second embodiment that rapidly shift in the counterclockwise direction. The hands 2 and 3 then shift in a sign-inverted velocity and return to the set position Pdm to complete a single stroke of the back and forth movement.

The hands 2 and 3 shift away from the set position Pdm by a distance (i.e., amplitude) corresponding to the velocity at the set position Pdm and return to the set position Pdm at the sign-inverted velocity. The returning hands 2 and 3 pass through the set position Pdm again, invert the sign of the velocity, and return to the set position Pdm again to complete another single stroke of the back and forth movement in the opposite direction. Specifically, the hands 2 and 3 are always accelerated at a certain rate toward the set position Pdm. After a full cycle of reciprocation (oscillation) of a sum of two strokes of the back and forth movement from the set position Pdm in opposite directions, the initial velocity V0 is damped (i.e., the amplitude is reduced) and another cycle of reciprocation is carried out. This cyclic movement of the hands 2 and 3 is repeated until the absolute value |V0| of the initial velocity V0 of the hands 2 and 3 finally fall below a predetermined lower limit. The hands 2 and 3 are then stepped at the set position Pdm.

Figure 12:
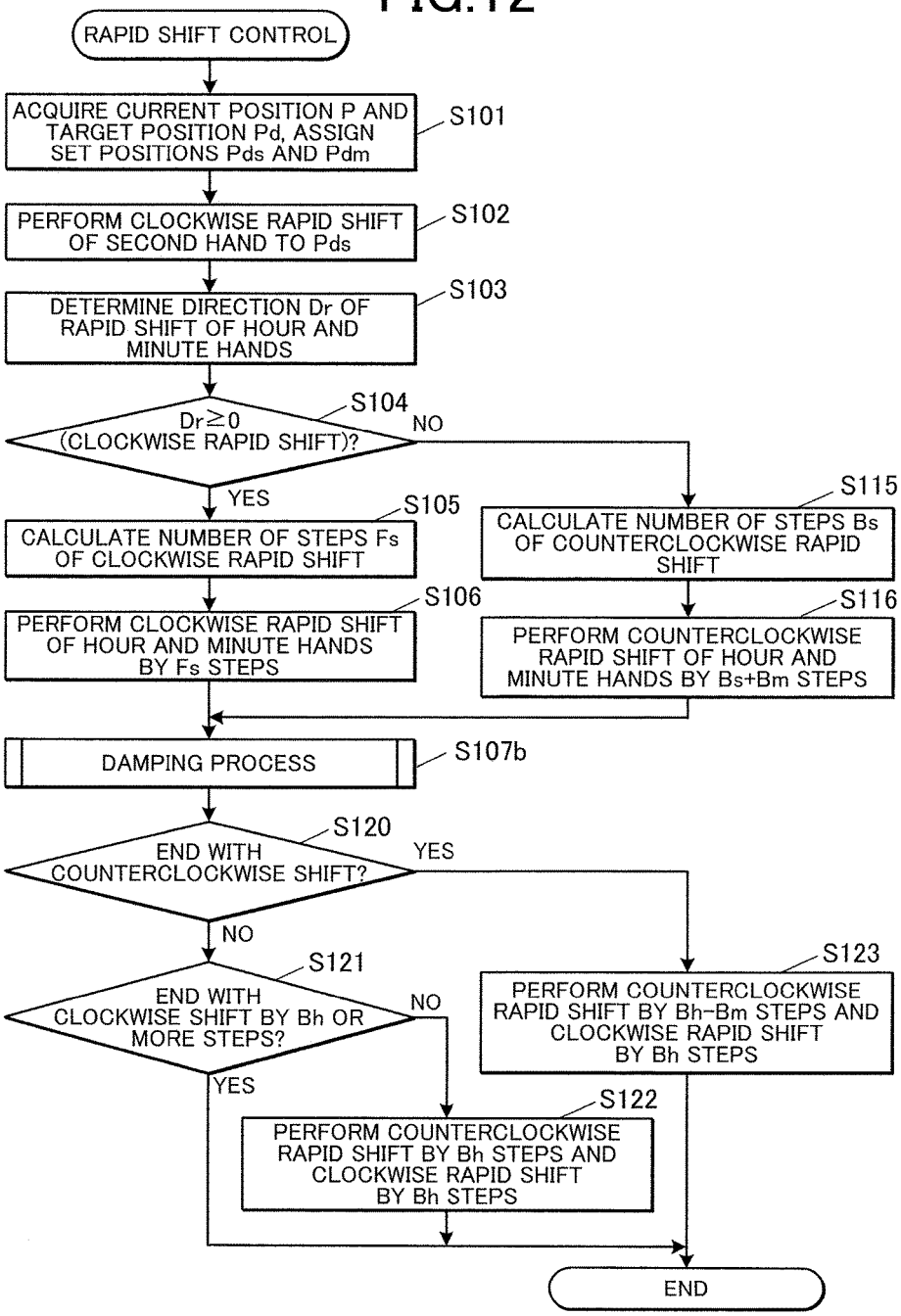
FIG. 12 is a flow chart illustrating rapid shift control carried out in the analog electronic timepiece according to the third embodiment.

FIG. 12 is a flow chart illustrating the rapid shift controlled by the CPU 46 in the analog electronic timepiece 1 according to this embodiment.

This rapid shift control is identical to that carried out in the analog electronic timepiece 1 according to the first embodiment, except that Step S107 is replaced by Step S107*b*. The steps that are identical are indicated by the same reference signs, and descriptions thereof are omitted.

Upon completion of Steps S106 and S116, the CPU 46 calls up and executes the oscillation damping process (Step S107*b*) The CPU 46 then carries out Step S120.

Figure 13:
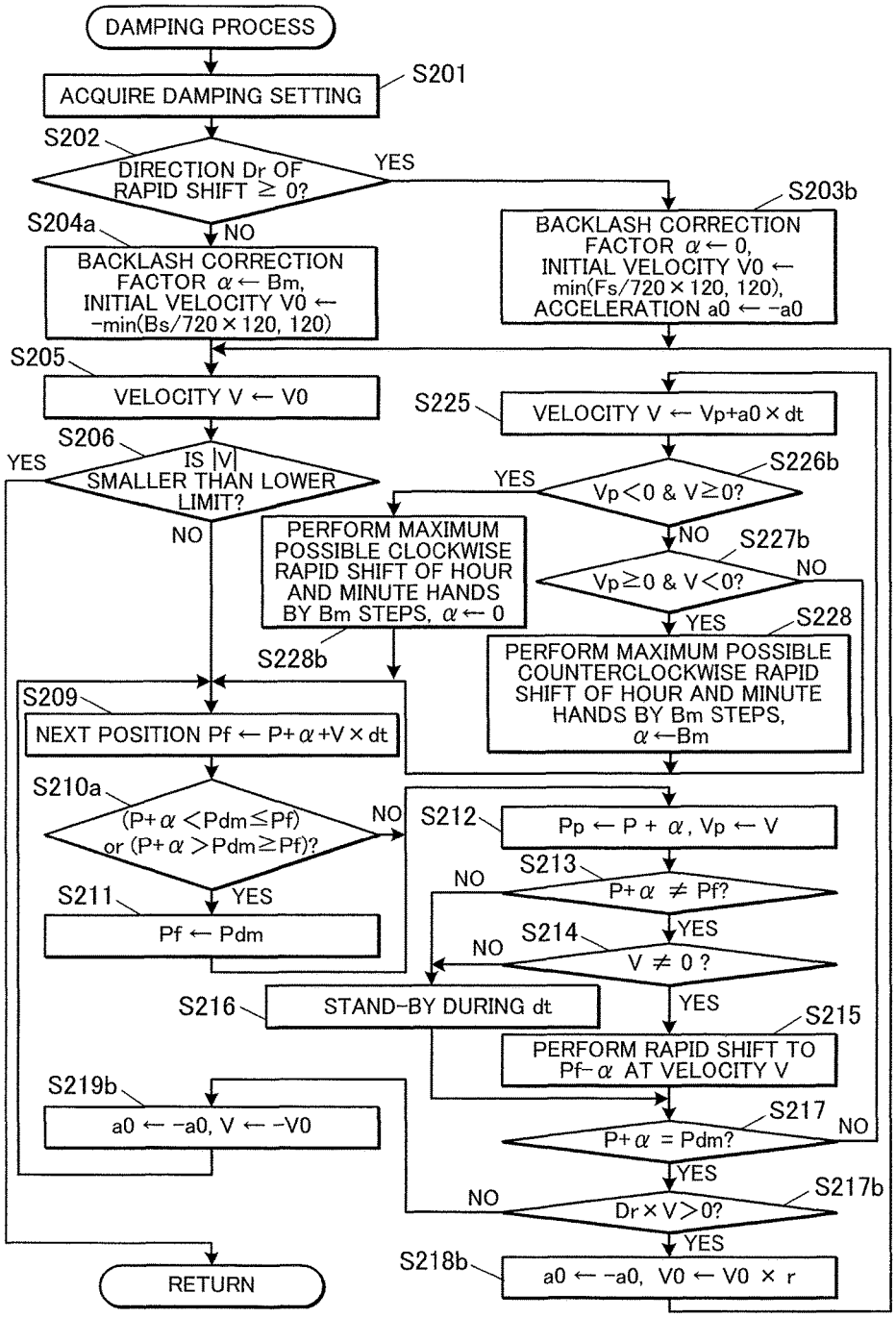
FIG. 13 is a flow chart illustrating the control process of oscillation damping called up during the rapid shift control according to the third embodiment.

FIG. 13 is a flow chart illustrating the control process of oscillation damping called up by the CPU 46 during the rapid shift control illustrated in FIG. 12.

This oscillation damping process is identical to the bouncing movement process illustrated in FIGS. 5 and 10, except that the Steps S203, S210, S218, and S226 are replaced by Steps S203*b*, S210*a*, S218*b*, and S226*b*, respectively, Steps S207 and S208 are omitted, and Steps S217*b*, S219*b*, S227*b*, and S228*b* are added. The steps that are identical are indicated by the same reference signs, and descriptions thereof are omitted.

In Step S202, if the direction Or of the rapid shift is 0 or larger, i.e., clockwise rapid shift (YES in Step S202), the CPU 46 assigns the numeric value "0" to the backlash correction factor α, assigns the smaller one of Fs/720×120 and 120 to the initial velocity V0, and multiplies the acceleration a0 with −1 to invert the sign (Step S203*b*). The CPU 46 then carries out Step S205. If the direction Dr of rapid shift is not 0 or larger i.e., if the rapid shift is not clockwise (is counterclockwise) (NO in Step S202), the CPU 46 carries out Step S204*a* and then Step S205.

After Step S209, the CPU 46 determines whether the next position Pf and the set position Pdm of the hour and minute hands satisfy (P+α<Pdm≤Pf) or (P+α>Pdm≤Pf) (Step S210*a*). If this relationship is satisfied (YES in Step S210*a*), i.e., if the hands rapidly shifted from the current position P to the next position Pf reach or pass through the set position Pdm, the CPU 46 updates the next position Pf to the set position Pdm (Step S211). The CPU 46 then carries out Step S212. If the relationship is not satisfied (NO in Step S210*a*), the CPU 46 carries out Step S212.

In Step S225, if the velocity V is updated, the CPU 46 determines whether the previous velocity Vp has a negative value and the velocity V is 0 or larger (Step S226*b*). If the previous velocity Vp has a negative value and the velocity V is 0 or larger (YES in Step S226*b*), the CPU 46 outputs a control signal to the driver circuit 49 and rapidly shifts the hour and minute hands by Bm steps in the clockwise direction at a maximum velocity. The CPU 46 assigns the numeric value "0" to the backlash correction factor α (Step S228*b*). The CPU 46 then carries out Step S209.

In Step S226*b*, if the previous velocity Vp is not a negative value (i.e., is 0 or larger) or if the velocity V is not 0 or lager (i.e., has a negative value) (NO in Step S226*b*) the CPU 46 determines whether the previous velocity Vp is 0 or larger and the velocity V has a negative value (Step S227*b*). If the previous velocity Vp is 0 or larger and the velocity V has a negative value (YES in Step S227*b*), the CPU 46 carries out Step S228. If the previous velocity Vp is not 0 or larger (i.e., has a negative value) or the velocity V is not a negative value (i.e., is 0 or larger) (NO in Step S227*b*), the CPU 46 carries out Step S209.

If the process goes to NO in Step S206, the CPU 46 carries out Step S209.

In Step S217, if the actual position (P+α) is equal to the set position Pdm (YES in Step S217), the CPU 46 determines whether the product of the direction Dr of the rapid shift carried out under the rapid shift control and the velocity V is larger than zero, i.e., whether the direction of rapid shift of the hour and minute hands is identical to the direction of oscillation of the hour and minute hands in the damping operation (Step S217*b*). If the directions are identical (YES in Step S217*b*), the CPU 46 inverts the sign of the acceleration a0 and multiplies the initial velocity V0 with the coefficient of restitution r (damping rate) (Step S218*b*) The CPU 46 then carries out Step S205.

In Step S217*b*, if the direction of rapid shift is not identical to the direction of shift of the hands 2 and 3 during this step in the oscillation damping operation (NO in Step S217*b*), the CPU 46 inverts the sign of the acceleration a0 and assigns a sign-inverted value of the initial velocity V0 to the velocity V (Step S219*b*). The CPU 46 then carries out Step S209.

In the analog electronic timepiece 1 according to the third embodiment, the reciprocation of the hands include oscillation about the center or target position (set position Pdm) at a predetermined amplitude, and the CPU 46 controls the damping of reciprocation to decrease the amplitude of the oscillation.

The oscillation about the center or target position allows sensuous perception of the end of the rapid shift by the user. Since the target position is the central position, the approximate position of the target position (set position Pdm) of the hands 2 and 3 can be recognized by the user even during the reciprocation damping control. This prevents the risk of failing in ready acquisition of information on the destination of the hands.

Fourth Embodiment

An analog electronic timepiece 1*c* according to a fourth embodiment will now be described.

Figure 14:
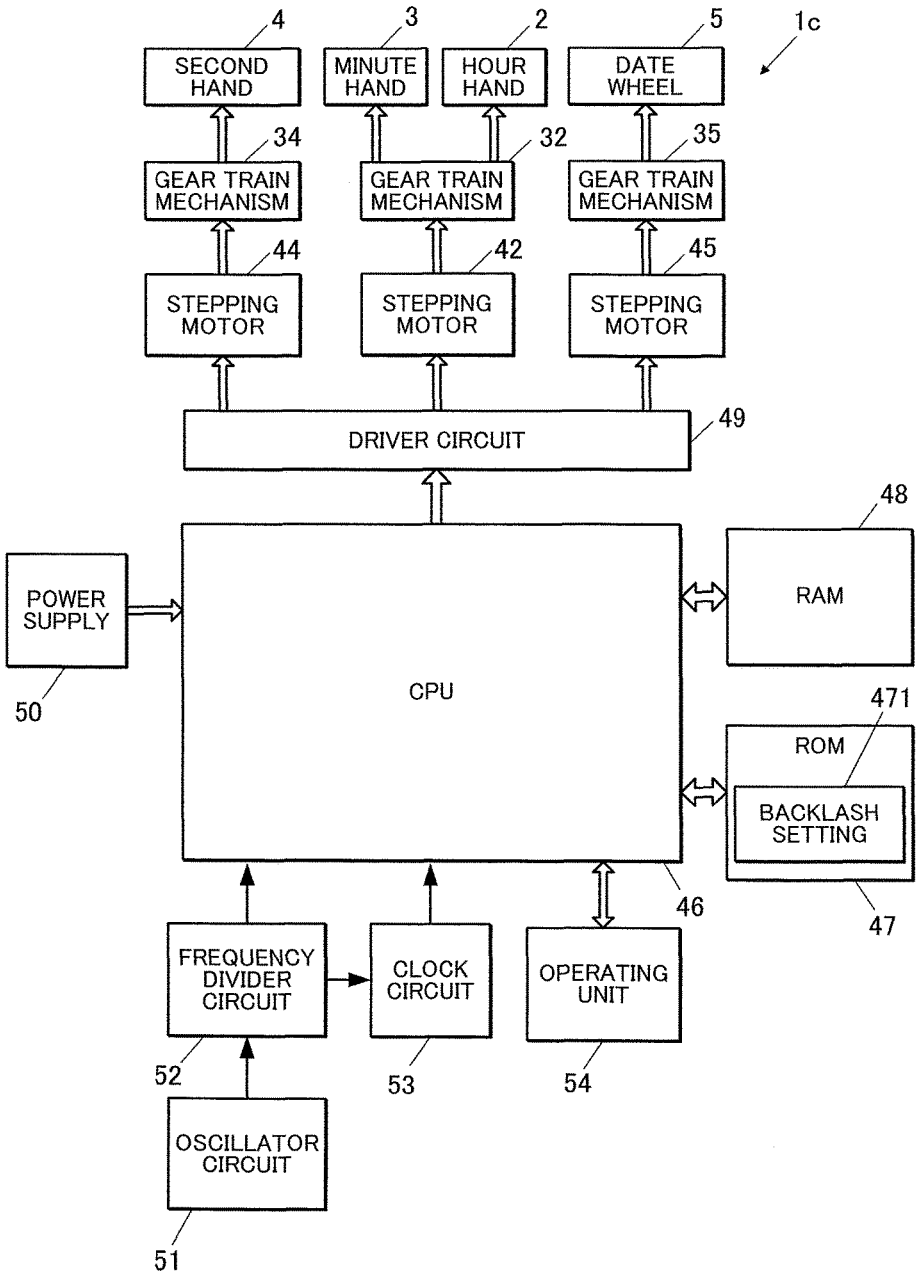
FIG. 14 is a block diagram illustrating the functional configuration of an analog electronic timepiece according to a fourth embodiment.

FIG. 14 is a block diagram illustrating the functional configuration of the analog electronic timepiece 1*c* according to this embodiment.

The configuration of the analog electronic timepiece 1*c* according to the fourth embodiment is identical to that of the analog electronic timepiece 1 according to the first embodiment, except that damping setting 472 are not stored in the ROM 47. The same reference signs are used for the same configurations, and descriptions thereof are omitted.

Figure 15:
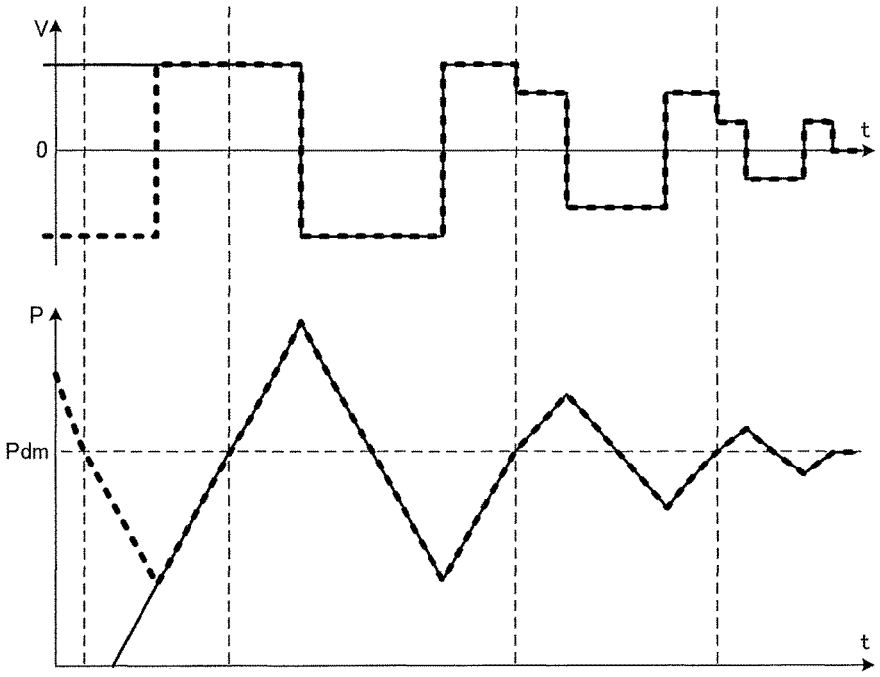
FIG. 15 illustrates the hour and minute hands of the analog electronic timepiece according to the fourth embodiment during a rapid shift.

FIG. 15 illustrates the hour hand 2 and the minute hand 3 of the analog electronic timepiece is according to this embodiment during rapid shift.

The analog electronic timepiece 1*c* according to the fourth embodiment carries out oscillation damping similar to that by the analog electronic timepiece 1 according to the third embodiment during clockwise rapid shift, as indicated by the solid line in the drawing. If the direction of rapid shift is the counterclockwise direction, a half cycle of reciprocation from the set position Pdm in the counterclockwise direction is added before the cycle of clockwise reciprocation from the set position Pdm in the first half of the first cycle of the clockwise oscillation damping, as indicated by the thick dotted line. Specifically, the oscillation damping of the counterclockwise rapid shift carried out after ending the half cycle of counterclockwise reciprocation is identical to that for the clockwise rapid shift.

In the analog electronic timepiece 1 according to this embodiment, the oscillation damping process always ends after the return movement of the hands in the cycle of counterclockwise reciprocation, i.e., during clockwise rapid shift. The number of steps in the shift should be larger than or equal to the number of backlash steps Bh to prevent redundant elimination of backlash, regardless of the direction of rapid shift, such as for the analog electronic timepiece 1 according to the second embodiment.

Figure 16:
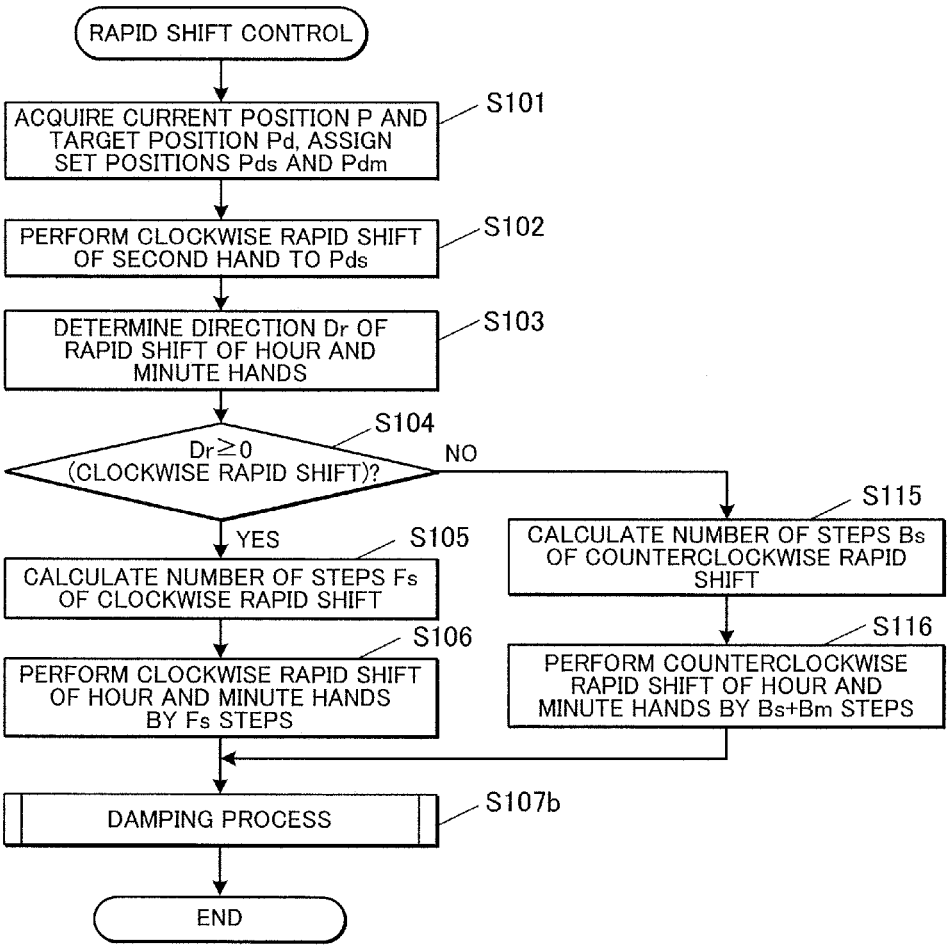
FIG. 16 is a flow chart illustrating a rapid shift control in the analog electronic timepiece according to the fourth embodiment.

FIG. 16 is a flow chart illustrating the rapid shift control carried out by the CPU 46 in the analog electronic timepiece 1*c* according to this embodiment.

This rapid shift control is identical to that according to the third embodiment illustrated in FIG. 12, except that Steps S120 to S123 are omitted. The same reference signs are used for the same configurations, and descriptions thereof are omitted.

Figure 17:
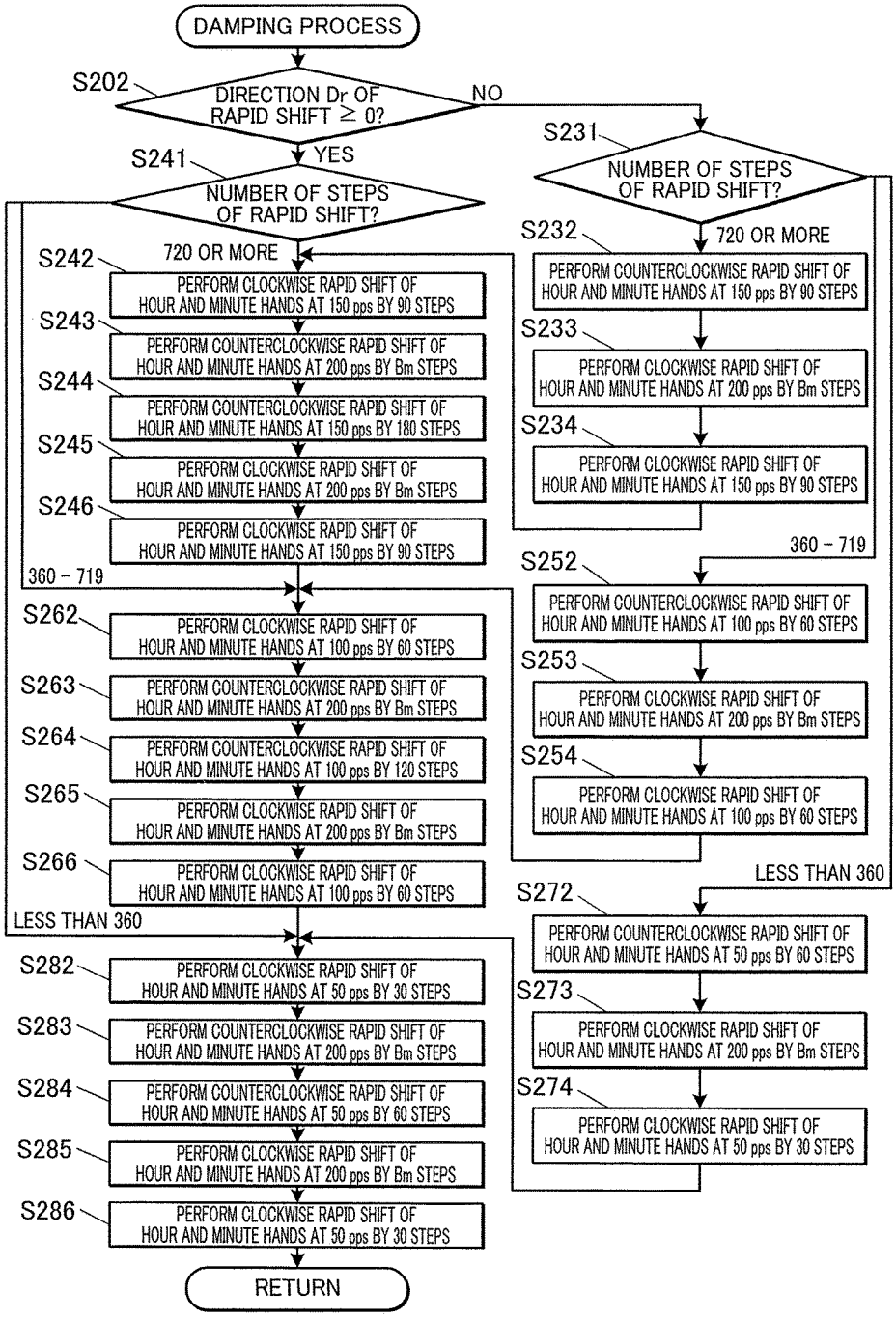
FIG. 17 is a flow chart illustrating the control process of oscillation damping called up during the rapid shift control according to the fourth embodiment.

FIG. 17 is a flow chart illustrating the control process of oscillation damping carried out by the CPU 46 of the analog electronic timepiece 1*c* according to this embodiment and called up during Step S107*b* of the rapid shift control.

This oscillation damping process differs from that called up in the analog electronic timepiece 1 according to the third embodiment in that the direction Dr of rapid shift is determined in Step S202 without the damping setting 472 (and thus Step S201 is omitted), the initial velocity V0 is then determined in accordance with the number of steps in the rapid shift, and the velocity of the rapid shift in each cycle and number of steps in each cycle are preliminarily determined.

The CPU 46 calls up the oscillation damping process and then determines whether the direction Dr of rapid shift is 0 or larger, i.e., in the clockwise direction (Step 9202). If the direction Dr is not 0 or larger (Le, the counterclockwise direction) (NO in Step S202) the CPU 46 determines the number of steps Bs in the counterclockwise rapid shift (Step S231).

If the number of steps Bs is 720 or more ("720 or more" in Step S231), the CPU 46 outputs a control signal to the driver circuit 49, rapidly shifts the hands 2 and 3 by 90 steps in the counterclockwise direction at 150 pps (Step S232), rapidly shifts the hands 2 and 3 by Bm steps in the clockwise direction at 200 pps (Step S233), and rapidly shifts the hands 2 and 3 by 90 steps in the clockwise direction at 150 pps (Step S234). The CPU 46 then carries out Step S242.

If the number of steps Bs in counterclockwise rapid shift is 360 or more and 719 or less ("360 to 719" in Step S231), the CPU 46 outputs a control signal to the driver circuit 49, rapidly shifts the hands 2 and 3 by 60 steps in the counterclockwise direction at 100 pps (Step S252), rapidly shifts the hands 2 and 3 by Bm steps in the clockwise direction at 200 pps (Step S253), and rapidly shifts the hands 2 and 3 by 60 steps in the clockwise direction at 100 pps (Step S254). The CPU 46 then carries out Step S262.

If the number of steps Bs in counterclockwise rapid shift is less than 360 ("less than 360" in Step S231), the CPU 46 outputs a control signal to the driver circuit 49, rapidly shifts the hands 2 and 3 by 30 steps in the counterclockwise direction at 50 pps (Step S272), rapidly shifts the hands 2 and 3 by Bm steps in the clockwise direction at 200 pps (Step S273), and rapidly shifts the hands 2 and 3 by 30 steps in the clockwise direction at 50 pps (Step S274). The CPU 46 then carries out Step S282.

In Step S202, if the direction Dr of rapid shift is 0 or larger (i.e., if the rapid shift is in the clockwise direction) (YES in Step S202), the CPU 46 determines the number of steps Fs in the clockwise rapid shift (Step S241).

If the number of steps Fs in clockwise rapid shift is 720 or more ("720 or more" in Step S241), the CPU 46 outputs a control signal to the driver circuit 49, rapidly shifts the hands 2 and 3 by 90 steps in the clockwise direction at 150 pps (Step S242), rapidly shifts the hands 2 and 3 by Bm steps in the counterclockwise direction at 200 pps (Step S243), and rapidly shifts the hands 2 and 3 by 180 steps in the counterclockwise direction at 150 pps (Step S244). The CPU 46 outputs a control signal to the driver circuit 49, rapidly shifts the hands 2 and 3 by Bm steps in the clockwise direction at 200 pps (Step 9245), and rapidly shifts the hands 2 and 3 by 90 steps in the clockwise direction (Step S246). The CPU 46 then carries out Step S262.

If the number of steps Fs in clockwise rapid shift is 360 or more and 719 or less ("360 to 719" in Step S241), the CPU 46 outputs a control signal to the driver circuit 49, rapidly shifts the hands 2 and 3 by 60 steps in the clockwise direction at 100 pps (Step S262), rapidly shifts the hands 2 and 3 by Bm steps in the counterclockwise direction at 200 pps (Step S263) and rapidly shifts the hands 2 and 3 by 120 steps in the counterclockwise direction at 100 pps (Step S 264). The CPU 46 outputs a control signal to the driver circuit 49, rapidly shifts the hands 2 and 3 by steps in the clockwise direction at 200 pps (Step S265), and rapidly shifts the hands 2 and 3 by 60 steps in the clockwise direction (Step S266). The CPU 46 then carries out Step S282.

If the number of steps Fs in clockwise rapid shift is less than 360 ("less than 360" in Step S241), the CPU 46 outputs a control signal to the driver circuit 49, rapidly shifts the hands 2 and 3 by 30 steps in the clockwise direction at 50 pps (Step S282), rapidly shifts the hands 2 and 3 by Bm steps in the counterclockwise direction at 200 pps (Step S283), and rapidly shifts the hands 2 and 3 by 60 steps in the counterclockwise direction at 50 pps (Step S284). The CPU 46 outputs a control signal to the driver circuit 49, rapidly shifts the hands 2 and 3 by Bm steps in the clockwise direction at 200 pps (Step S285), and rapidly shifts the hands 2 and 3 by 30 steps in the clockwise direction (Step S286). The CPU 46 then ends the oscillation damping process and returns to the rapid shift process.

The oscillation damping process called up during the rapid shift process of the analog electronic timepiece 1*c* according to this embodiment always ends during Steps S282 to S286, regardless of the direction Dr of the rapid shift, the number of steps Fs in clockwise rapid shift, and the number of steps Bs in counterclockwise rapid shift. Thus, the hands 2 and 3 rapidly shift in the counterclockwise direction by a number of steps larger than the number of backlash steps Bh (which is six steps in this embodiment) to the set position Pdm in the clockwise direction and then stops. Thus, the gear train mechanism 32 associated with the turning of the hands 2 and 3 after this step has no allowance for clockwise turning. Thus, elimination is not required for the backlash.

The analog electronic timepiece 1 according to the fourth embodiment is similar to the analog electronic timepiece 1 according to the second embodiment, in that the CPU 46 controls the damping of reciprocation such that the number of steps in the final clockwise shift of the hands 2 and 3 driven by the gear train mechanism 32 is at least the number of backlash steps Bh. Thus, redundant backlash elimination is not required for the clockwise turning after the reciprocation damping control. This achieves comfortable and appropriate notification of the end of the rapid shift to the user.

During a single cycle of oscillation, parameters other than the sign of the velocity is maintained constant while the velocity and the amplitude are gradually decreased every cycle. Thus, the CPU 46 can readily control the damping of reciprocation without acceleration.

Fifth Embodiment

An analog electronic timepiece 1*c* according to the fifth embodiment will now be described.

The configuration of the analog electronic timepiece 1*c* according to the fifth embodiment is identical to that of the analog electronic timepiece 1*c* according to the fourth embodiment. Thus, the same components are indicated by the same reference sign, and descriptions thereof are omitted.

In the analog electronic timepiece is according to the fifth embodiment, the hands rapidly shifted in the counterclockwise direction bounce once at the set position Pdm such that the initial velocity of the hands at the set position Pdm is identical to that of the hands rapidly shifted in the clockwise direction. Subsequently, an oscillation damping process similar to that of the analog electronic timepiece is according to the fourth embodiment is carried out. The rapid shift always ends in a clockwise shift from a position at least h steps in the counterclockwise direction from the set position Pdm, regardless of the original direction of the rapid shift. This prevents redundant elimination of backlash, as in the analog electronic timepiece 1 according to the second embodiment and the analog electronic timepiece is according to the fourth embodiment.

Figure 18:
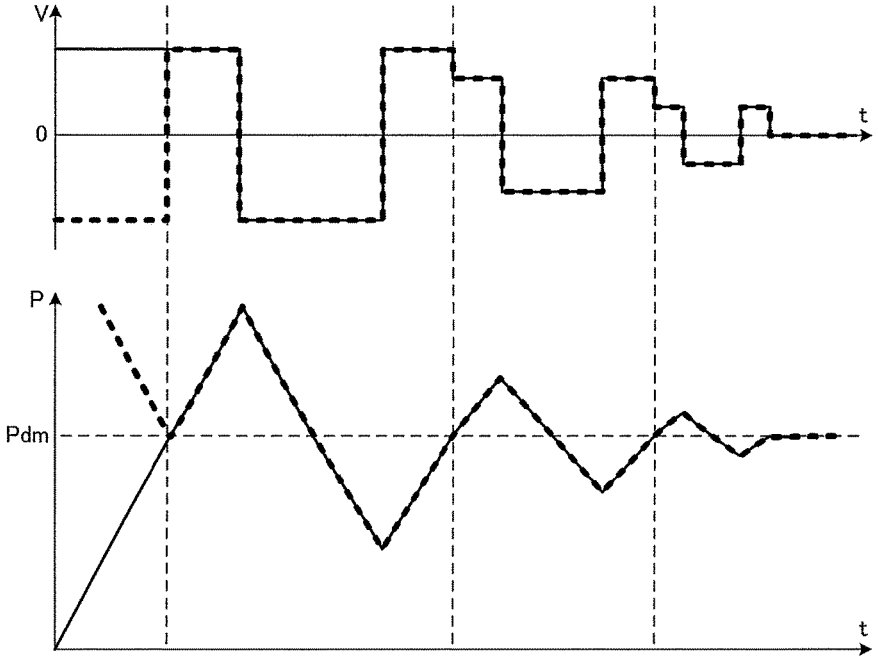
FIG. 18 illustrates the hour and minute hands of an analog electronic timepiece according to a fifth embodiment during a rapid shift.

FIG. 18 illustrates the hour and minute hands 2 and 3 of the analog electronic timepiece 1*c* according this embodiment during rapid shift.

The analog electronic timepiece 1*c* according to the fifth embodiment damps oscillation in the clockwise rapid shift in the same manner as the analog electronic timepiece 1 according to the third embodiment, as indicated by the solid lines. In counterclockwise rapid shift, the hands bounce once at the set position Pdm, as indicated by the thick dotted lines. The hands then pass through the set position Pdm without bouncing at the set position Pdm while the initial velocity V0 of the hands is damped every cycle.

Each cycle of reciprocation during the oscillation damping process is always first carried out on the clockwise side of the set position Pdm (farther side) and then carried out on the counterclockwise side of the set position Pdm (closer side). The oscillation damping process ends after completing a full cycle of reciprocation on the counterclockwise side, i.e. during clockwise rapid shift. The number of steps in the rapid shift should be at least the number of backlash steps Bh, to prevent redundant elimination of the backlash regardless of the direction of the rapid shift, as in the analog electronic timepiece 1 according to the second embodiment.

Figure 19:
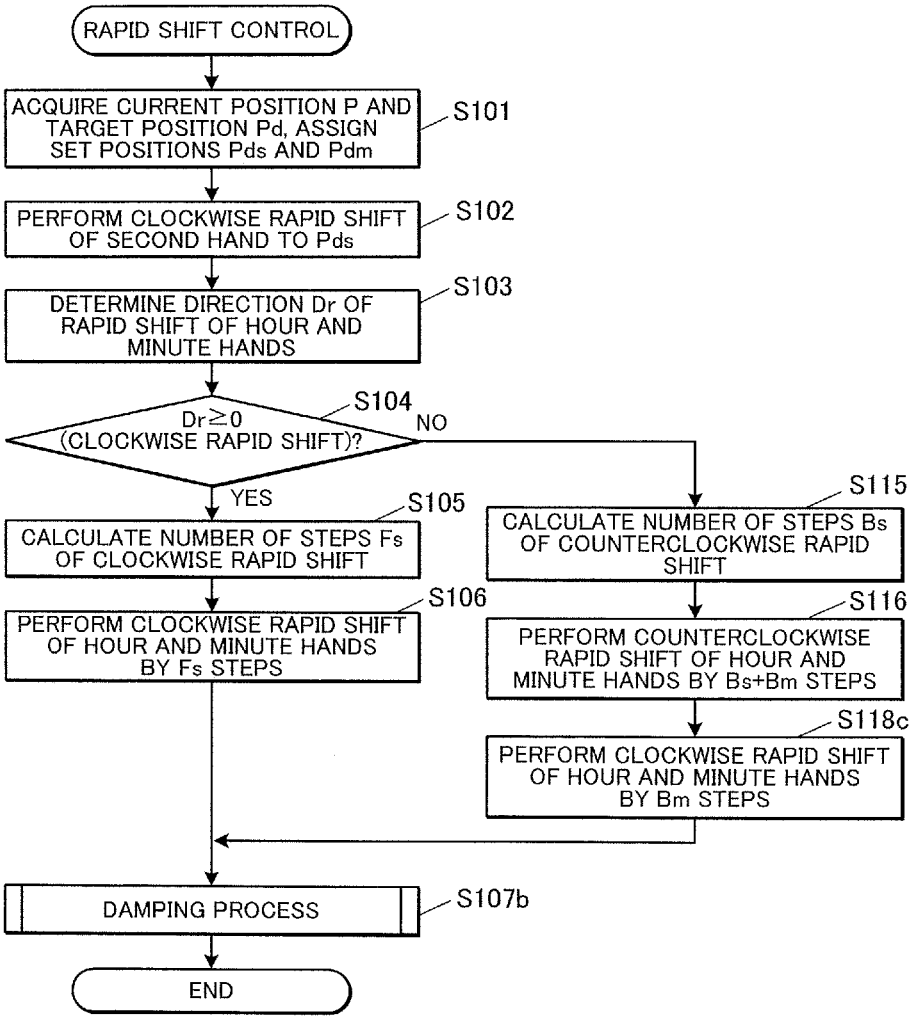
FIG. 19 is a flow chart illustrating rapid shift control in the analog electronic timepiece according to the fifth embodiment.

FIG. 19 is a flow chart illustrating the rapid shift controlled by the CPU 46 in the analog electronic timepiece 1*c* according to this embodiment.

The rapid shift control is identical to that carried out in the analog electronic timepiece 1*c* according to the fourth embodiment illustrated, in FIG. 16, except that Step S118*c* is added. The same components are indicated by the same reference sign, and descriptions thereof there omitted.

In Step S116, upon completion of the counterclockwise rapid shift of the hour and minute hands, the CPU 46 outputs a control signal to the driver circuit 49 and rapidly shifts the hour and minute hands by Bm steps in the clockwise direction at a maximum rate (200 pps) (Step S118*c*). The CPU 46 then calls up and executes the oscillation damping process (Step S107*b*).

Figure 20:
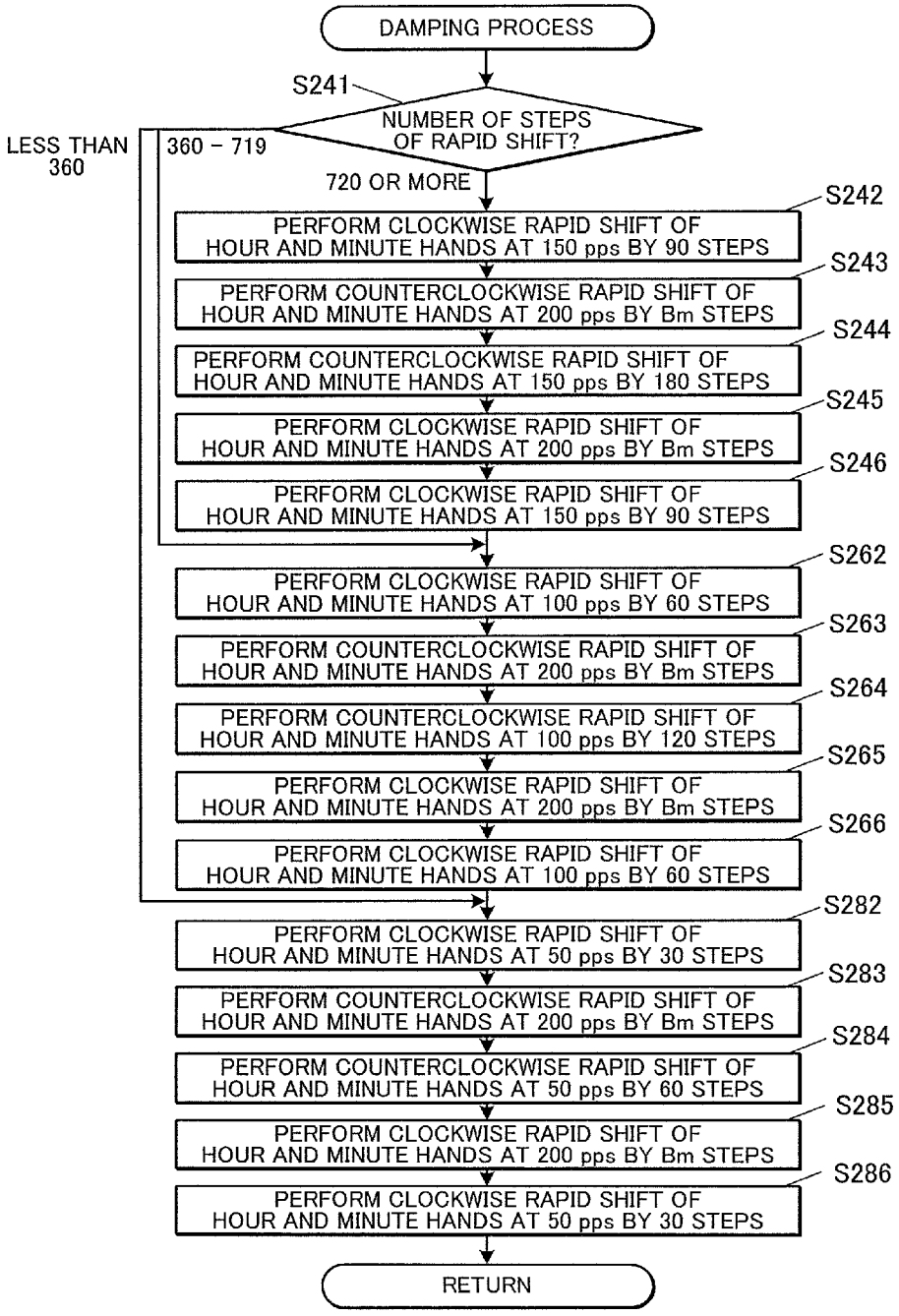
FIG. 20 is a flow chart illustrating the control process of oscillation damping called up during the rapid shift control according to the fifth embodiment.

FIG. 20 is flow chart illustrating the control process of the oscillation damping carried out by the CPU 46 of the analog electronic timepiece is according to this embodiment and called up during the rapid shift control. The oscillation damping process is identical to that according to the fourth embodiment illustrated in FIG. 17, except that Steps S202, S231 to S234, S252 to S254, and S272 to S274 are omitted. The same components are indicated by the same reference sign, and descriptions thereof are omitted. The process carried out by the analog electronic timepiece is according to this embodiment in response to the call-up of the damping process is identical to the damping process carried out by the analog electronic timepiece 1*c* according to the fourth embodiment when the direction Dr of the rapid shift is 0 or larger (the clockwise direction).

The analog electronic timepiece is according to the fifth embodiment gradually decreases the velocity and the distance of shift (number of steps) in every cycle of oscillation without varying the acceleration, in a manner similar to the analog electronic timepiece 1*c* according to the fourth embodiment. Thus, ready control of the damping of reciprocation can be achieved. When the hands reach the target position through clockwise rapid shift, the hands directly enter the damping process, whereas when the hands reach the target position through counterclockwise rapid shift, the hands bounce once and then enter the damping process. This difference in the movement of the hands 2 and 3 indicating additional information on the rapid shift can be sensuously perceived by the user. Since the reciprocation ends in the clockwise rapid shift, regardless of the original direction of the rapid shift, if the number of steps of the final shift is at least the number of backlash steps Bh, redundant elimination of backlash is prevented.

Sixth Embodiment

An electronic timepiece according to a sixth embodiment will now be described.

Figure 21:
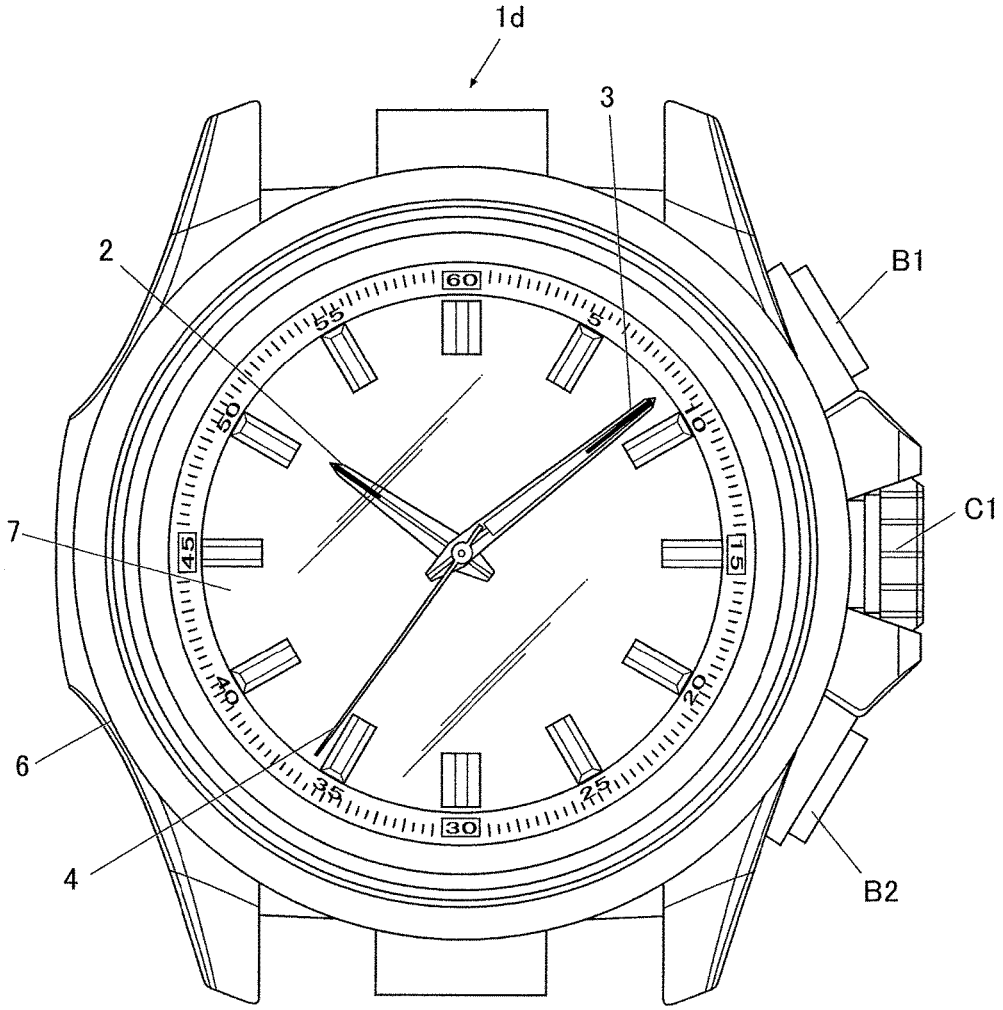
FIG. 21 is a front view of an analog electronic timepiece according to a sixth embodiment.

FIG. 21 is a front view illustrating an analog electronic timepiece 1*d* according to the sixth embodiment.

The analog electronic timepiece 1*d* is identical to the analog electronic timepiece 1 according to the first embodiment, except that a date wheel 5 and an opening 7*a* in the timepiece face 7 through which the date wheel 5 is exposed are not provided. The other external components are identical, and descriptions thereof are omitted.

Figure 22:
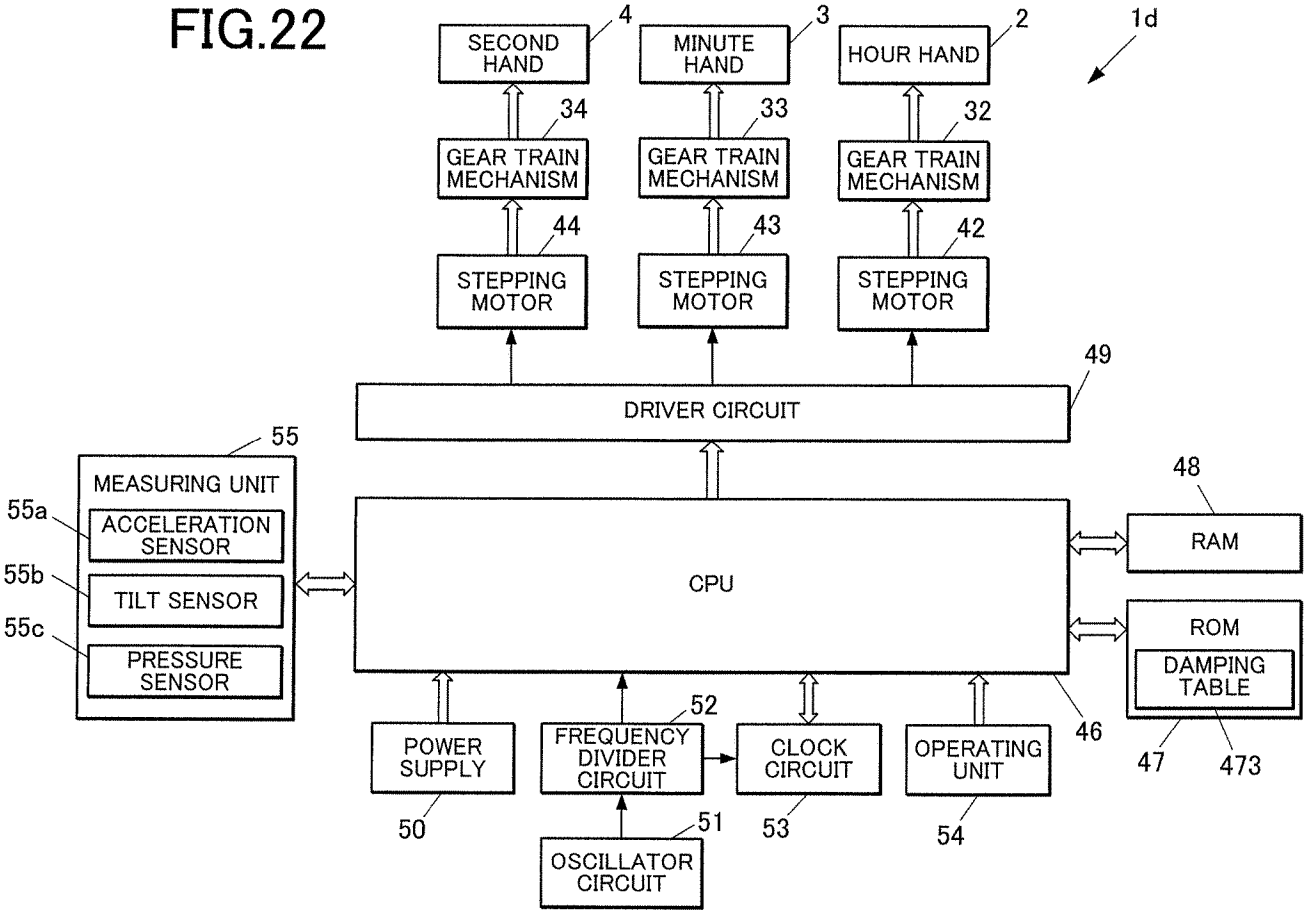
FIG. 22 is a block diagram illustrating a functional configuration of the analog electronic timepiece according to the sixth embodiment.

FIG. 22 is a block diagram illustrating the functional configuration of the analog electronic timepiece 1*d* according to the sixth embodiment.

The analog electronic timepiece 1*d* according to the sixth embodiment is identical to the analog electronic timepiece 1 according to the first embodiment, except that a measuring unit 55 is added, a date wheel 5, a gear train mechanism 35, and a stepping motor 45 are not provided, and the hour hand 2 and the minute hand 3 are independently driven by the stepping motors 42 and 43, respectively, via the gear train mechanisms 32 and 33, respectively. The minute hand 3 and the hour hand 2 each have positions "0" to "359," where position "0" corresponds to the 12 o'clock position (0-minute position) and positions "1" to "359" are assigned in an ascending order along the clockwise direction. The storage unit or ROM 47 stores an oscillation damping table 473 containing the temporal variation in the position of the hands corresponding to the shift of the hands imitating damping of oscillation (hereinafter, this shift is simply referred to as "damping").

The other components are identical to those in the analog electronic timepiece 1 according to the first embodiment. The same components are indicated by the same reference signs, and descriptions thereof are omitted.

The measuring unit 55 includes a gravitational-force-direction detector or acceleration sensor 55*a*, a tilt measuring unit or tilt sensor 55*b*, and a pressure sensor 55*c*. The data detected by the sensors in the measuring unit 55 is converted to electrical signals by a driver (not shown) and output to the CPU 46.

The acceleration sensor 55*a* is a triaxial accelerometer that can measure gravitational acceleration. It is preferred that two of the three axes reside in a plane parallel to the timepiece face 7, i.e., parallel to the plane of rotation of the hands 2 to 4, and the other axis extend in a direction orthogonal to the timepiece face 7. The acceleration sensor 55*a* can detect the direction of gravitational force through measurement of gravitational acceleration.

The tilt sensor 55*b* detects the tilt of the timepiece face 7 of the analog electronic timepiece 1*d* (the tilt angle of the plane of rotation of the hands 2 to 4 relative to the horizontal plane). The detection of the tilt by the tilt sensor 55*b* may be any known detection scheme that has low power consumption and can qualitatively detect a change in the direction of tilt.

The pressure sensor 55*c* can measure hydraulic pressure in water. An exemplary pressure sensor 55*c* is a semiconductor sensor including piezoelectric elements.

The shift of the hands in the analog electronic timepiece 1*d* according to the sixth embodiment will now be described.

In the analog electronic timepiece 1*d* according to the sixth embodiment, the direction of gravitational force is displayed on a plane parallel to the timepiece face 7 with the second hand 4 (tertiary hand) on the basis of the data on acceleration measured by the acceleration sensor 55*a*. The second hand 4 of the analog electronic timepiece 1*d* damps oscillation at an initial amplitude A (having a positive or negative value), which is the difference between the position of the hand (target position G) corresponding to the determined direction of gravitational force and the initial position (starting point) of the second hand 4. The damping of velocity in a single cycle of oscillation of the hand is considered through reference of the oscillation damping table 473 in the ROM 47. In the analog electronic timepiece 1*d* according to this embodiment, the velocity of the rapid shift varies even before reaching the set position Pdm.

FIG. 23 illustrates the example content of the oscillation damping table 473.

An example of the information on the variation in the hand position stored in the oscillation damping table 473 is the relative position $Pr(t_k)$ ($0 \le k \le n$) for each update interval dt of the velocity in step units (6 degree units) of the second hand 4, where the origin is at the central position O of the damped simple harmonic motion. The relative position $Pr(t_k)$ corresponding to the variable k is stored. Alternatively, the oscillation damping table 473 may store information on the shift of the hand or information on the variation in the velocity of the hand during each updating interval dt, in place of the information on the variation in the hand position.

The relative position $Pr(t_n)$ (n=18 in this example) is the final destination of the shift, i.e., the central position O. A large damping rate (small damping constant) of oscillation extends the time until the hand stops at the final position. Thus, the user cannot readily acquire the direction of gravitational force. A small damping rate causes excess damping. Thus, an effective display cannot be provided to the user. The damping rate should preferably be determined such that the second hand 4 oscillates for approximately 1.5 to 2.5 cycles (for example, between one and two cycles) starting from the initial position and then stops at the central position O. For example, the amplitude should be constantly or exponentially reduced to approximately ½ to ¼ (for example, ½ or smaller) in each half cycle. The relative position $Pr(t_k)$ may be less rigorous and can be a value that allows the user to recognize the damping in a comfortable manner.

The relative position $Pr(t_k)$ is multiplied by the initial amplitude A and added to an offset value determined to be the difference between the central position O and the target position G, to acquire the position of the hand at predetermined times. Specifically, the instructed position $F(t_k)=A\times P(t_k)+G$ at time $t_k$ is sequentially assigned as a destination to each updating interval dt, and the velocity $V(t_k)=(F(t_k)-F(t_k-1)/dt$ of the shift of the second hand 4 is assigned. When damping is carried out across the position "0" of the hand, the numeric value "60" is added to or subtracted from the value of the acquired position of the hand such that the second hand 4 resides within the range of positions "0" to "59."

Figure 24:
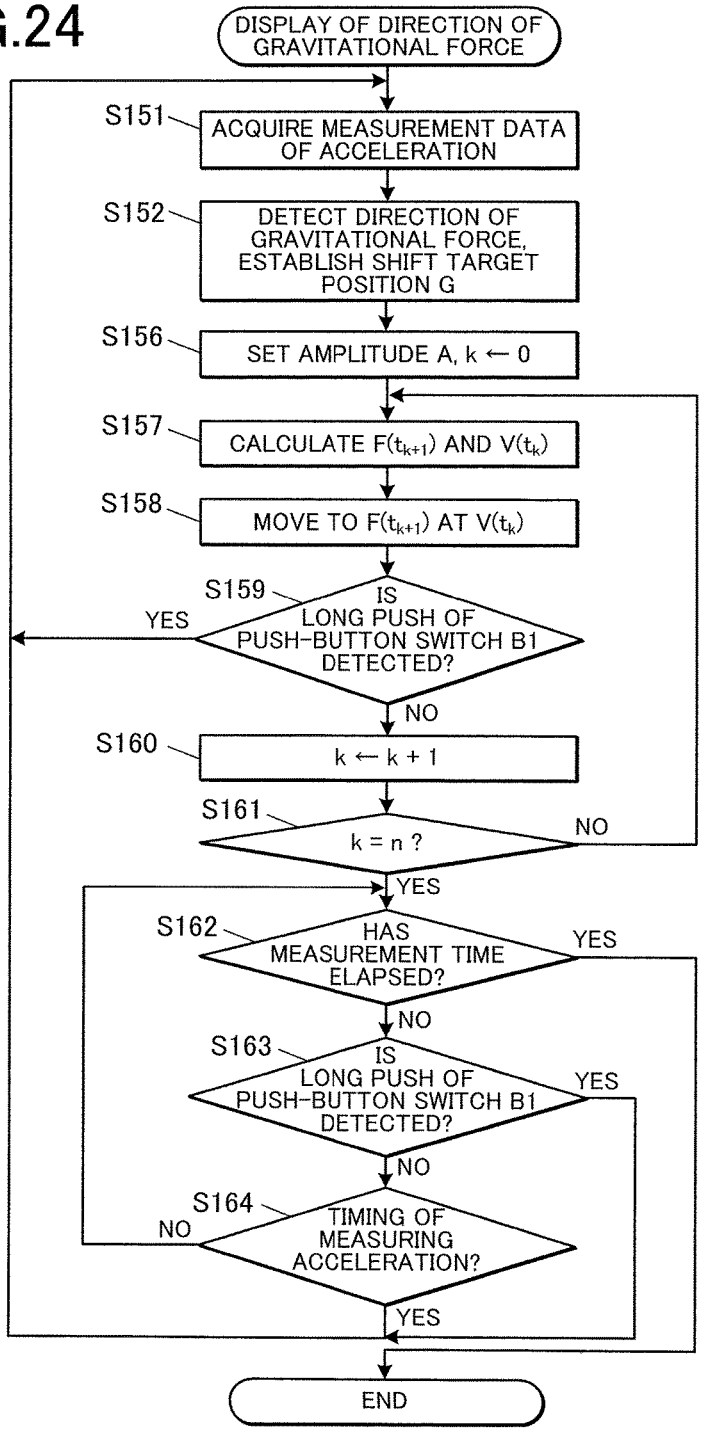
FIG. 24 is a flowchart illustrating the control process of displaying the direction of gravitational force in the analog electronic timepiece according to the sixth embodiment.

FIG. 24 is a flow chart illustrating the control process of displaying the direction of gravitational force carried out by the CPU 46 in the analog electronic timepiece 1*d* according to this embodiment.

The display process of gravitational force starts in response to a long-push of the push-button switch B1, for example. Alternatively, this process may be automatically started when the hydraulic pressure measured by the pressure sensor 55*c* exceeds a predetermined value (for example, 1.3 atmosphere (approximately 1317 hPa)).

Upon start of the display of the gravitational force, the CPU 46 outputs an instruction for measurement to the acceleration sensor 55*a* and acquires measured data on acceleration (Step S151). The CPU 46 determines the direction of gravitational force on the timepiece face 7 on the basis of the acquired data on acceleration and determines the direction of the second hand 4 corresponding to the direction of gravitational force as the final target position G (Step S152).

The CPU 46 assigns the difference between the current position of the second hand 4 and the determined target position G as the initial amplitude A (Step S156). The CPU 46 assigns the numeric value "0," which is the initial value, to the variable k (step) that indicates time. The CPU 46 calculates the indicating position $F(t_k+1)$ of the second hand 4 in the step next to the current step (i.e., after one updating interval dt) and the velocity $V(t_k)$ between the current indicating position $F(t_k)$ and the subsequent indicating position $F(t_k+1)$ (Step S157).

The CPU 46 outputs a control signal to the driver circuit 49 and shifts the second hand 4 at the calculated velocity $V(t_k)$ to the indicating position $F(t_k+1)$ (Step S158). The CPU 46 determines whether a long-push of the push-button switch B1 is detected (Step S159). If a long-push is detected (YES in Step S159), the CPU 46 carries out Step S151. If a long-push is not detected (NO in Step S159), the CPU 46 adds the numeric value "1" to the variable k (Step S160) and determines whether the variable k is equal to the final number of steps n (Step S161). If the variable k is not equal to the final number of steps n (NO in Step S161), the CPU 46 carries out S157.

If the variable k is equal to the final number of steps n (YES in Step S161), the CPU 46 determines whether a predetermined measuring time of acceleration has elapsed (in this example, one minute from the beginning of the displaying process for gravitational force) (Step S162). If the measuring time has elapsed (YES in Step S162), the CPU 46 outputs a control signal to the driver circuit 49, returns the second hand 4 to the original indicating position (if the original position corresponds to the current time, the time that has elapsed during the operation for displaying the gravitational force is added to the time corresponding to the original position to display the updated current time), and the display process of gravitational force ends.

If the measuring time has not elapsed (NO in Step S162), the CPU 46 determines whether a long-push of the push-button switch B1 is detected (Step S163). If a long-push is detected (YES in Step S163), the CPU 46 carries out S151.

If a long-push of the push-button switch B1 is not detected (NO in Step S163), the CPU 46 determines whether it is the next timing for measuring acceleration (Step S164) If it is not the timing for measuring acceleration (NO in Step S164), the CPU 46 carries out S162. If it is the timing for measuring acceleration (YES in Step S164), the CPU 46 carries out Step S151.

FIGS. 25A to 25F illustrate example displays of gravitational force in the analog electronic timepiece 1*d* according to this embodiment.

When the position corresponding to the gravitational force is detected to be the 6 o'clock position on the timepiece face 7, i.e., the 30-second position or position F42, as illustrated in FIG. 25B, while the second hand 4 indicates the 9 o'clock position on the timepiece face 7 i.e., the 45-second position or position F41, as illustrated in FIG. 25A, the position F42 is assigned to the target position G and the numeric value "15" is assigned to the initial amplitude A.

With reference to the oscillation damping table 473, the CPU 46 sequentially establishes the indicating positions $F(t_1)$ to $F(t_n)$ and the velocity $V(t_1)$ to $V(t_n)$ of the shift for each updating interval dt starting from the position F41 and rapidly shifts the second hand 4 while varying the velocity in multiple steps (predetermined steps) from the velocity $V(t_1)$ to $V(t_n)$ If the velocities are limited by fixed numbers of steps due to limitations on the stepping motor 44, velocities closest to the fixed values can be established to be the velocity $V(t_1)$ to $V(t_n)$. With reference to FIG. 25C, among the velocities $V(t_1)$ to $V(t_7)$ (respectively corresponding to V1 to V7 in the drawing) in the first half cycle of damping operation, the highest is the velocity $V(t_4)$ (V4 in the drawing) of the period in which the position F42 or direction of gravitational force is passed through or the previous velocity $V(t_3)$ (V3 in the drawing), whereas the lowest is the velocity $V(t_7)$ (V7 in the drawing) immediately before stop. The relative position $Pr(t_7)$ in the second half cycle is 0.5, and the indicating position $F(t_7)$ at a pause of the second hand 4 is the 23-second position or position F43 (position "23" of the second hand 4) on the basis of the product (rounded value) of the initial amplitude A and the relative position $Pr(t_7)$.

In the half cycle of the second damping operation, the second hand 4 rapidly shifts from the indicating position $F(t_7)$ or position F43 to the indicating position $(t_{14})$ such that the velocity reaches a maximum value during the period of shifting from the relative position $Pr(t_{10})$ to the $Pr(t_{11})$, as illustrated in FIG. 25D. The relative position $Pr(t_{14})$ is 0.25, which is half of $Pr(t_7)$, and thus the indicating position $F(t_{14})$ is the 33-second position or position F44 (position "33" of the second hand 4). If the distance of shift during the updating interval dt is smaller than one, the hand may appropriately shift, for example, through rounding off during acceleration and rounding up during deceleration.

In the first half cycle of the third oscillation damping operation, the second hand 4 shifts from the indicating position $F(t_{14})$ to the final indicating position $F(t_n)$ or position F42 corresponding to the target position G, as illustrated in FIG. 25E.

With reference to FIG. 25F, the second hand 4 stays at the target position G (position F42) until the second hand 4 shifts to an updated target position G determined through the next measurement of acceleration, or the second hand 4 returns to the original position after the period of measuring acceleration ends.

The analog electronic timepiece 1*d* according to this embodiment includes the acceleration sensor 55*a* that detects the direction of gravitational force. The CPU 46 calculates the hand position (central position O) corresponding to the gravitational force detected by the acceleration sensor 55*a* and shifts the second hand 4 on the plane of rotation of the second hand 4 from a predetermined or initial position to the calculated position, which is the target position G. The CPU 46 damps the oscillation of the second hand 4 from the starting position or predetermined position (initial position) about the central position O or origin.

The second hand 4 converges to the direction of gravitational force (target position G) while damping the oscillation like the movement of a pendulum. In this way, the user can sensuously perceive the direction of gravity, unlike simple indication of the direction of gravitational force. In particular, such hand movement can allow a scuba diver in water, where the direction of gravitational force is difficult to sensuously perceive, to certainly perceive the direction of the water surface.

A ROM 47 is provided that stores an oscillation damping table 473 containing at least one of information on the variation in the hand position and information on the variation in the velocity of the hand during damping, according to a predetermined origin and initial amplitude. The CPU 46 damps the oscillation of the second hand 4 on the basis of the initial position, the target position G, and the oscillation damping table 473.

This readily achieves the damping of the oscillation of the second hand 4 without a processing load of calculating the position of the hand every time.

The CPU 46 varies the velocity of the second hand 4 in at least two predetermined steps on the basis of the oscillation damping table 473, to damp the oscillation. This allows the shift of the hand to approximate damping of oscillation within a range allowable to the operation. Even when the number of steps for the driving velocity that can be established in the stepping motor 44 is limited, oscillation can be damped within the limited number of steps.

The initial position of the damping is the position of the second hand 4 before the start of the damping of oscillation. Thus, the second hand 4 does not require the troublesome operation of moving to a predetermined position before the damping of oscillation. A small variation in the values of the gravitational force measured sequentially at predetermined intervals causes a small amplitude of the damped oscillation. This allows ready perception of the absence of a large variation in the orientation of the body of the user.

The analog electronic timepiece 1*d* according to this embodiment includes a stepping motor 44 that turns the second hand 4 in response to the control of the CPU 46. The stepping motor 44 shifts the second hand 4 at a maximum velocity of 200 pps in both the clockwise and counterclockwise directions. Thus, the rapid shift involving the damping can be readily achieved in both the clockwise and counterclockwise direction.

The CPU 46 damps the amplitude of the oscillation to ½ or less every half cycle of the damping operation. This prevents a long damping operation that prevents certain perception of the direction of gravitational force by the user or causes the user to lose his or her concentration. Since the distance of the shift per step of the second hand 4 is large (six degrees), reciprocation of a small number of steps may not appear as oscillation. The damping operation can be ended while the operation is still visually effective.

The CPU 46 stops the second hand 4 at the target position G at any single timing during the first and second cycles. This prevents prolonged oscillation that prevents ready recognition of the direction of gravitational force, as described above. Once the amplitude of the oscillation is damped to a certain level, shift in steps do not appear as oscillation. The damping operation can thus be ended when the amplitude is damped to an appropriate level before this level.

Seventh Embodiment

An analog electronic timepiece 1*d* according to a seventh embodiment will now be described.

The functional configuration of the analog electronic timepiece 1*d* according to the seventh embodiment is the same as that of the analog electronic timepiece 1*d* according to the sixth embodiment. The same components are indicated by the same reference signs, and descriptions thereof are omitted.

The indication of the direction of gravitational force in the analog electronic timepiece 1*d* according to the seventh embodiment is the same as that in the analog electronic timepiece 1*d* according to the sixth embodiment, except that the hour hand 2 and the minute hand 3 (primary hand) indicate the horizontal direction. Other operations are the same, and descriptions thereof are omitted.

Figure 26:
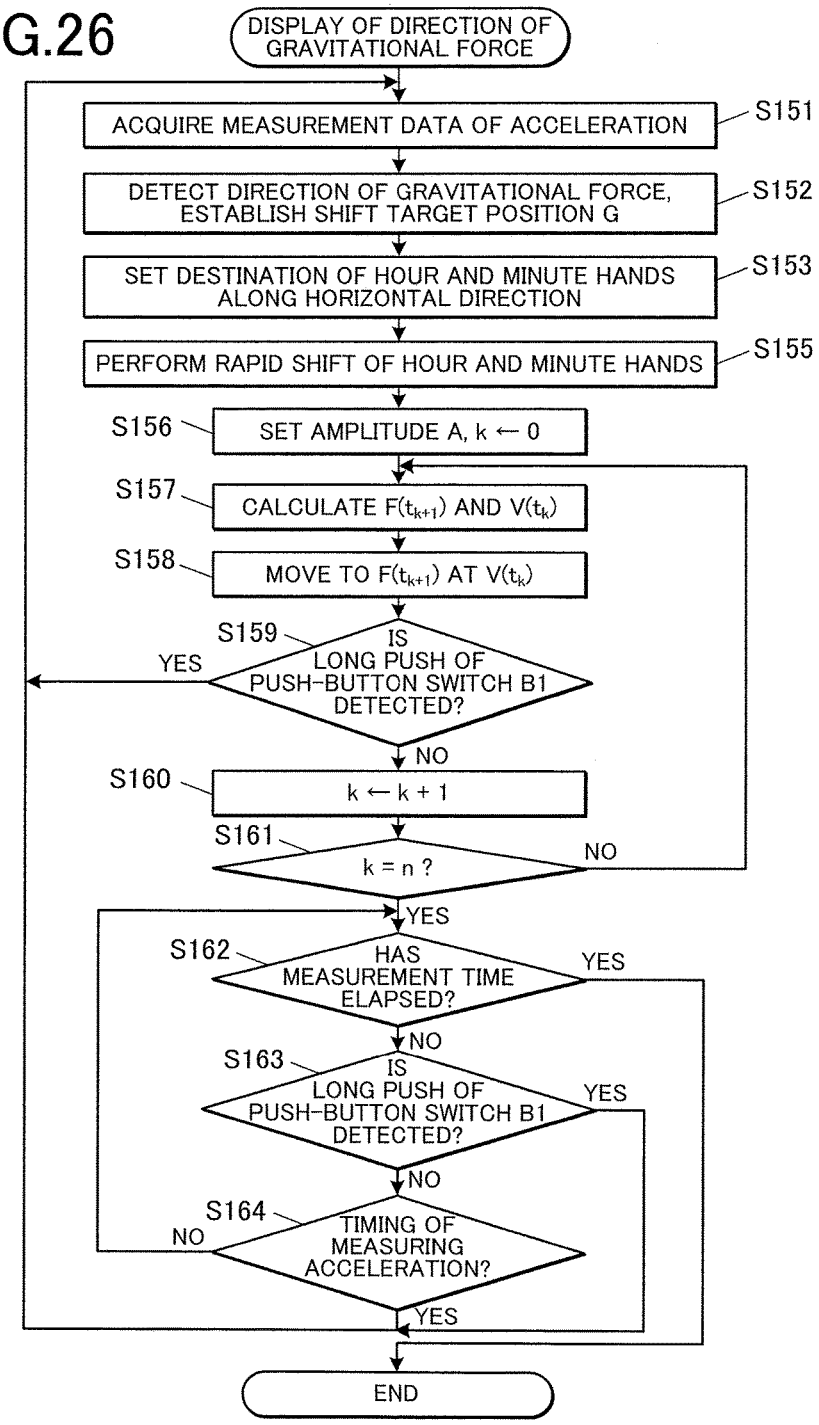
FIG. 26 is a flowchart illustrating the control process of displaying the direction of gravitational force in an analog electronic timepiece according to a seventh embodiment.

FIG. 26 is a flow chart illustrating the control process of displaying the direction of gravitational force carried out by the CPU 46 in the analog electronic timepiece 1*d* according to the seventh embodiment.

This display process of the direction of gravitational force is identical to that according to the sixth embodiment, except that Steps S153 and S155 are added. The same steps are indicated by the same reference signs, and descriptions thereof are omitted.

Upon completion of Step S152 in this display process of the direction of gravitational force, the CPU 46 acquires the position of the hour hand 2 and the minute hand 3 corresponding to the target position G, i.e., the position corresponding to the value of the position of the second hand 4 multiplied by six. The CPU 46 then assigns the position at 90 degrees to the target position G in the clockwise direction (position indicating horizontal direction), i.e., the position 90 steps passed the target position G, to the destination of the hour hand 2, and assigns the position 90 degrees to the target position G in the counterclockwise direction, i.e., the position 90 steps short of the target position G, to the destination of the minute hand 3 (Step S153). The CPU 46 outputs a control signal to the driver circuit 49 and rapidly shifts the hour hand 2 and the minute hand 3 to the destinations (Step S155). The velocity of the rapid shift of the hour hand 2 and the minute hand 3 may be constant, or the velocity of one of the hands 2 and 3 may be larger than the other so that the hour hand 2 and the minute hand 3 simultaneously arrive at the destinations.

The CPU 46 then carries out Step S156.

Figure 27A:
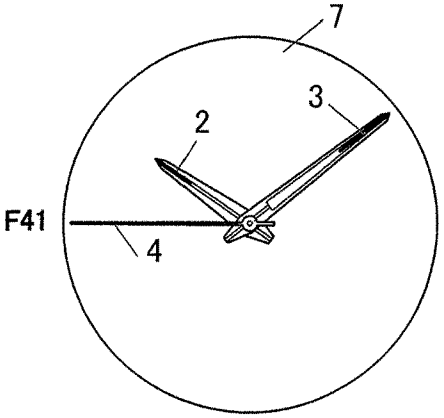
FIGS. 27A to 27C illustrate an example display of the direction of gravitational force in the analog electronic timepiece according to the seventh embodiment.
Figure 27B:
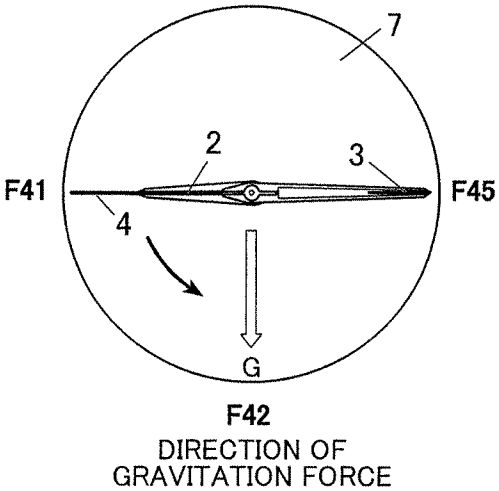
Figure 27C:
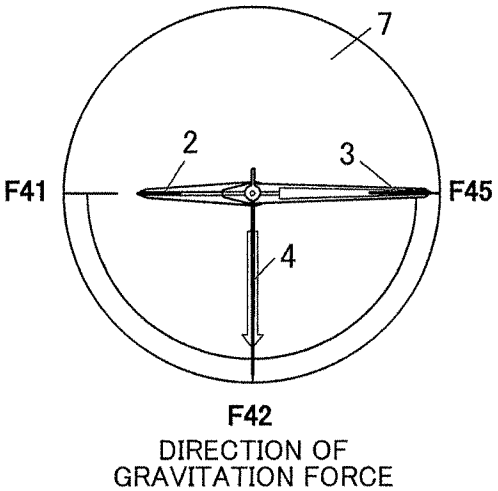

FIGS. 27P to 27C illustrate an example display of gravitational force in the analog electronic timepiece 1*d* according to this embodiment.

As illustrated in FIG. 27B, once the target position G of the second hand 4, i.e., position "30," corresponding to the position F42 representing the direction of gravitational force is assigned, the position "180" of the hour hand 2 and minute hand 3 corresponding to the position F42 is determined, the position "270" (position F41) is assigned to the destination of the hour hand 2, and the position "90" (position F45) is assigned to the destination of the minute hand 3. The hour hand 2 and the minute hand 3 then rapidly shift to their destinations.

The second hand 4 remains at the position F41, which is the initial position of the second hand 4, during the rapid shift of the hour hand 2 and the minute hand 3. The second hand 4 may also rapidly shift to the position F41 or F45 to achieve sufficient damping of the second hand 4. In this step, the second hand 4 remains still at its original position F41. With reference to FIG. 27C, the hour hand 2 and the minute hand 3 remain still while the second hand 4 is damped in the same manner as in the analog electronic timepiece 1*d* according to the sixth embodiment.

The analog electronic timepiece 1*d* according to the seventh embodiment includes a minute hand 3 and a hour hand 2 that can turn around the same rotational axis as the second hand 4. The CPU 46 shifts the minute hand 3 and the hour hand 2 to different horizontal display positions (positions F41 and F45), each being different from the target position G by 90 degrees.

The user can readily recognize the oscillation of the second hand 4 about the direction of gravitational force based on the horizontal plane.

The CPU 46 assigns one of the two horizontal display positions (positions F41 and F45), which are each different from the target position G by 90 degrees, to the initial position, shifts the second hand 4 to the initial position, and damps the oscillation of the second hand 4. In this way, damping can be certainly carried out at the same initial amplitude every time. Thus, the user can visually perceive the display.

Eighth Embodiment

An analog electronic timepiece 1*d* according to an eighth embodiment will now be described.

The functional configuration of the analog electronic timepiece 1*d* according to the eighth embodiment is identical to that of the analog electronic timepiece 1*d* according to the sixth embodiment. The same steps are indicated by the same reference signs, and descriptions thereof are omitted.

The display of the direction of gravitational force in the analog electronic timepiece 1*d* according to the eighth embodiment is identical to the display of the direction of gravitational force in the analog electronic timepiece 1*d* according to the sixth embodiment, except that the minute hand 3 (primary hand) indicates the horizontal direction and the hour hand 2, which is a secondary hand, indicates the tilt angle of the display face (plane of rotation of the hands 2 to 4) of the analog electronic timepiece 1*d* to the horizontal plane. Other operations are the same, and descriptions thereof are omitted.

Figure 28:
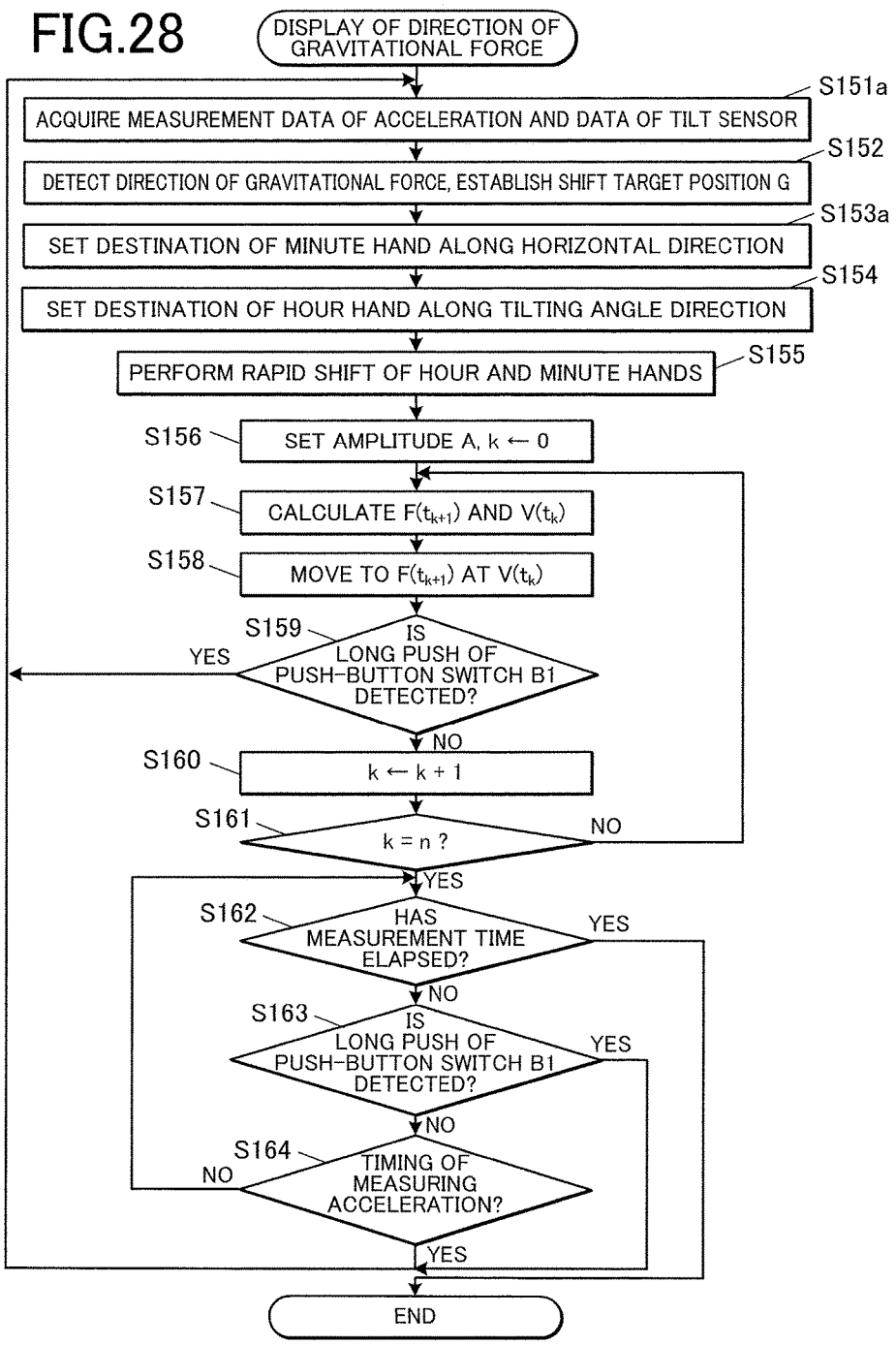
FIG. 28 is a flow chart illustrating the control process of displaying the direction of gravitational force in an analog electronic timepiece according to an eighth embodiment.

FIG. 28 is a flow chart illustrating the control process of displaying the direction of gravitational force carried out by the CPU 46 in an analog electronic timepiece 1*d* according to an eighth embodiment.

This display process of the direction of gravitational force is identical to that according to the seventh embodiment, except that Steps S151 and S153 are replaced by Steps S151*a* and S153*a*, respectively, and Step S154 is added. The same steps are indicated by the same reference signs, and descriptions thereof are omitted.

Upon start of the display of the direction of gravitational force, the CPU 46 acquires data on acceleration measured by the acceleration sensor 55*a* and the data measured by the tilt sensor 55*b* (Step S151*a*). The CPU 46 then carries out Step S152.

Upon completion of Step S152, the CPU 46 calculates the horizontal direction (the position 90 degrees to the direction of gravitational force in the clockwise or counterclockwise direction) and assigns the horizontal direction as the destination of the minute hand 3 (Step S153*a*). Whether the position should be on the clockwise side or the counterclockwise side may be predetermined or may be determined in response to the initial position of the minute hand 3 relative to the position F42.

The CPU 46 assigns the position of the hand corresponding to the tilt angle acquired by the tilt sensor 55*b* to the destination of the hour hand 2 (Step S154). The tilt angle acquired by the tilt sensor 55*b* is within the range of 0 to 90 degrees (negative or positive value). The CPU 46 then carries out Step S155.

Figure 29A:
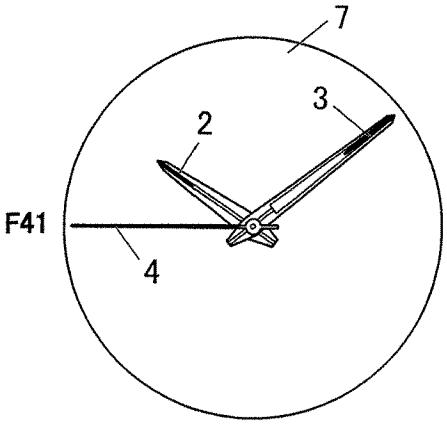
FIGS. 29A to 29C illustrate an example display of the direction of gravitational force in the analog electronic timepiece according to the eight embodiment.
Figure 29B:
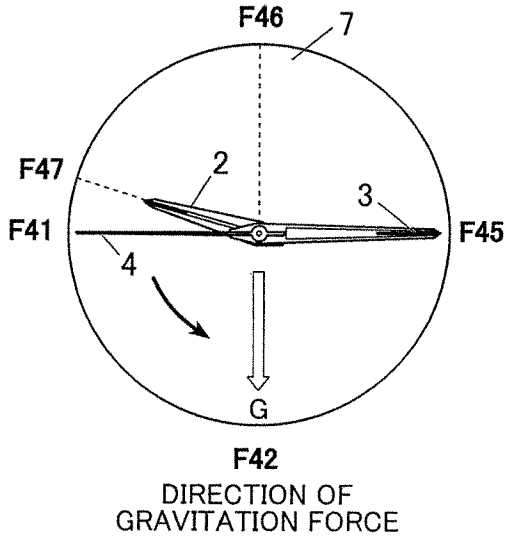
Figure 29C:
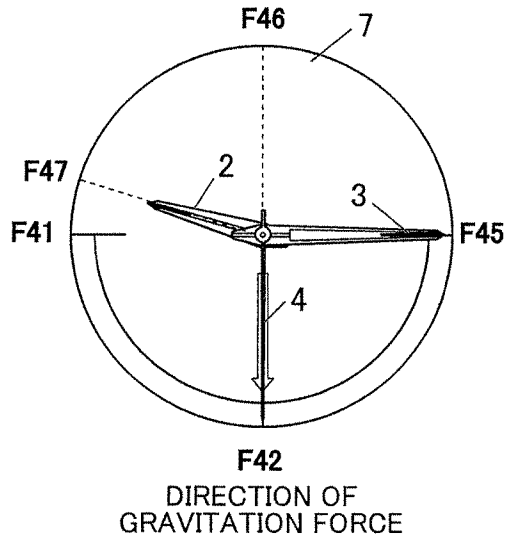

FIGS. 29A to 29C illustrate an example display of gravitational force in the analog electronic timepiece 1*d* according to this embodiment.

With reference to FIG. 29B, the position F41 of the hour hand 2 corresponds to a tilt angle of 0 degrees and is 180 degrees to the position F45 indicating the horizontal direction determined in Step S153*a*, and the position F46 corresponds to a tilt angle of 90 degrees and is 180 degrees to the position F42 indicating the direction of gravitational force. If the tilt angle is between 0 and 90 degrees, the destination (position F47) shifts from the position F41 toward the position F45 in accordance with the tilt angle.

With reference to FIG. 29C, the oscillation of the second hand 4 is damped while the hour hand 2 and the minute hand 3 are not moving.

The analog electronic timepiece 1*d* according to the eighth embodiment includes a hour hand 2 that can turn on a plane parallel to the plane of rotation of the second hand 4 (i.e., a plane horizontal to the timepiece face) and a tilt sensor 55*b* that measure the tilt angle of the plane of rotation of the hands 2 to 4 relative to the horizontal plane. The CPU 46 shifts the hour hand 2 to the position F47, which is at the measured tilt angle to one of two horizontal display positions (positions F41 and F45), each 90 degrees to the target position G.

This allows the tilt to be perceived even on a tilted timepiece face. The precise direction of gravitational force (not only the components of the gravitational force on the display face) can be displayed so that, for example, a scuba diver can appropriately determine and adjust the orientation of his or her body and the directions of emergence and submergence in consideration of the tilt angle when the diver in the water wants to quickly surface.

The present invention should not be limited to the embodiments described above and may include various modifications.

For example, in the first to fifth embodiments, the minute hand 3 and the hour hand 2 rapidly shift in cooperation with each other, and in the sixth to eighth embodiments, the second hand 4 shifts independently. The hands may rapidly shift in any manner, for example, in manners opposite to those described in the embodiments. Any hands other than hands 2 to 4 may also rapidly shift. For example, functional hands involving other functional operations and small hands for a world clock may also rapidly shift.

The hands according to the embodiments described above carried out the bouncing and oscillation. Alternatively, the hands may move in any other pattern. The patterns of velocity and acceleration may be appropriately adjusted within a certain range including the reference position (target position).

In the embodiments described above, the amplitude of reciprocation varies in accordance with the number of steps in rapid shift. Alternatively, the amplitude may be constant. Alternatively, the patterns of velocity and acceleration may vary; in accordance h the number of steps in rapid shift.

In the first to fifth embodiments, the magnitude of the movement varies every cycle. Alternatively, the magnitude of movement may vary every half cycle to achieve fine control of the damping. The amplitude may vary every half cycle such that the amplitude of the reciprocation on the upstream side of the rapid shift is smaller than magnitude of the movement (amplitude) of the reciprocation on the downstream side of the rapid shift, for example.

In the embodiments described above, the direction of gravitational force is detected and displayed. Alternatively, the present invention may be applied to a configuration that displays values corresponding to other physical sensors.

The detailed configuration, control processes, and example displays of the embodiments described above may be modified without departing from the scope of the present invention.

The embodiments described above should not be construed to limit the present invention, and the scope of the invention includes the claims and equivalents thereof.

What is claimed is:

1. An electronic timepiece comprising:

a turnable hand;

a processor that controls a turn of the hand, wherein when the processor performs a rapid shift of the hand to a set target position, the processor performs a control of a damping of a reciprocation of the hand in which the hand performs a reciprocation by a predetermined number of steps about the target position as a reference position and gradually decreases an amplitude of the reciprocation of the hand during the rapid shift; and a gravitational force direction detector that detects a direction of gravitational force, wherein:

the processor calculates a position of the hand on a plane of rotation of the hand in accordance with the direction of gravitational force detected by the gravitational force direction detector, the processor performs the control of the damping of the reciprocation of the hand by setting the calculated position of the hand as the target position and damping the reciprocation of the hand about the target position as a center by setting a predetermined position as a starting point, and the processor performs the control of the damping of the reciprocation of the hand after the hand shifts to the predetermined position, the predetermined position being one of two different positions each of which is different from the target position by 90 degrees.

2. The electronic timepiece according to claim 1, wherein the processor continues to perform the control of the damping of the reciprocation of the hand after the hand reaches the target position.

3. The electronic timepiece according to claim 2, wherein:

the reciprocation of the hand includes bouncing of the hand in which a direction of the hand reaching the target position from a predetermined incident direction is inverted at the target position and the hand is returned in an opposite direction by a predetermined distance, and the processor performs the control of the damping of the reciprocation of the hand by repeating the bouncing while decreasing the predetermined distance.

4. The electronic timepiece according to claim 3, wherein the predetermined incident direction is defined to be identical to a direction of the rapid shift of the hand.

5. The electronic timepiece according to claim 2, wherein:

the reciprocation of the hand includes oscillation about the target position at a predetermined amplitude, and the processor performs the control of the damping of the reciprocation of the hand by oscillating the hand while decreasing the predetermined amplitude.

6. The electronic timepiece according to claim 1, wherein the processor determines the amplitude of the reciprocation of the hand at the beginning of the reciprocation of the hand based on an amount of the rapid shift of the hand.

7. The electronic timepiece according to claim 1, wherein the processor varies a velocity of the hand in accordance with a positive acceleration in a direction from a position of the hand to the target position during the reciprocation of the hand.

8. The electronic timepiece according to claim 1, wherein the processor decreases the amplitude of the reciprocation of the hand during each cycle of the reciprocation of the hand.

9. The electronic timepiece according to claim 1, wherein the processor performs the control of the damping of the reciprocation of the hand during the reciprocation of the hand by shifting the hand in a predetermined direction of a final shift to reach the target position and stopping the hand at the target position.

10. The electronic timepiece according to claim 1, further comprising:

a storage unit that stores, as hand shifting information, at least one of information on a variation in a hand position and information on a variation in a velocity of the hand during the damping of the reciprocation of the hand corresponding to a predetermined center and an initial amplitude, wherein the processor performs the control of the damping of the reciprocation of the hand based on the predetermined position, the target position, and the hand shifting information.

11. The electronic timepiece according to claim 10, wherein the processor performs the control of the damping of the reciprocation of the hand while varying the velocity of the hand in at least two predetermined steps based on the hand shifting information.

12. The electronic timepiece according to claim 1, wherein the predetermined position is indicated by the hand in accordance with an operation previous to the damping of the reciprocation of the hand.

13. The electronic timepiece according to claim 1, wherein:

the processor comprises a hand driver that turns the hand in response to a control by the processor, and a maximum velocity of the hand shifted in the clockwise direction by the hand driver is set to be equal to a maximum velocity of the hand shifted in the counter-clockwise direction by the hand driver.

14. The electronic timepiece according to claim 1, wherein the processor damps the amplitude of the reciprocation of the hand to ½ or less during every half cycle of the damping of the reciprocation of the hand.

15. The electronic timepiece according to claim 1, wherein the processor stops the hand at any timing at which the hand reaches the target position during the first to second cycles of the damping of the reciprocation of the hand.

16. An electronic timepiece comprising:

a turnable hand;

a processor that controls a turn of the hand, wherein when the processor performs a rapid shift of the hand to a set target position, the processor performs a control of a damping of a reciprocation of the hand in which the hand performs a reciprocation by a predetermined number of steps about the target position as a reference position and gradually decreases an amplitude of the reciprocation of the hand during the rapid shift; and a gravitational force direction detector that detects a direction of gravitational force, wherein:

the processor calculates a position of the hand on a plane of rotation of the hand in accordance with the direction of gravitational force detected by the gravitational force direction detector, the processor performs the control of the damping of the reciprocation of the hand by setting the calculated position of the hand as the target position and damping the reciprocation of the hand about the target position as a center by setting a predetermined position as a starting point, the electronic timepiece includes a primary hand, a secondary hand, and a tertiary hand, the hand used in carrying out the damping of the reciprocation of the hand is the tertiary hand, the primary hand turns around the same rotational axis as the tertiary hand, and the processor shifts the primary hand to one of two different positions each of which is different from the target position by 90 degrees.

17. An electronic timepiece comprising:

a turnable hand;

a processor that controls a turn of the hand, wherein when the processor performs a rapid shift of the hand to a set target position, the processor performs a control of a damping of a reciprocation of the hand in which the hand performs a reciprocation by a predetermined number of steps about the target position as a reference position and gradually decreases an amplitude of the reciprocation of the hand during the rapid shift;

a gravitational force direction detector that detects a direction of gravitational force; and a tilt measuring unit that measures a tilt angle of a plane of rotation relative to a horizontal plane, wherein:

the processor calculates a position of the hand on a plane of rotation of the hand in accordance with the direction of gravitational force detected by the gravitational force direction detector, the processor performs the control of the damping of the reciprocation of the hand by setting the calculated position of the hand as the target position and damping the reciprocation of the hand about the target position as a center by setting a predetermined position as a starting point, the electronic timepiece includes a primary hand, a secondary hand, and a tertiary hand, the hand used in carrying out the damping of the reciprocation of the hand is the tertiary hand, the secondary hand is turnable on a plane parallel to a plane of rotation of the tertiary hand, and the processor shifts the secondary hand to a position having an angle corresponding to the tilt angle relative to one of two different positions each of which is different from the target position by 90 degrees.

* * * * *